US011115750B2

(12) United States Patent
Monsarrat-Chanon et al.

(10) Patent No.: US 11,115,750 B2
(45) Date of Patent: Sep. 7, 2021

(54) SYSTEM, DEVICE AND METHOD FOR ASSESSING A FIT QUALITY OF AN EARPIECE

(71) Applicant: Ecole de Technologie Superieure, Montreal (CA)

(72) Inventors: Hami Monsarrat-Chanon, Montreal (CA); Jeremie Voix, Montreal (CA); Vincent Nadon, Montreal (CA); Thomas Habrant, Bordeaux (FR)

(73) Assignee: Ecole de Technologie Superieure, Montreal (CA)

( * ) Notice: Subject to any disclaimer, the term of this patent is extended or adjusted under 35 U.S.C. 154(b) by 0 days.

(21) Appl. No.: 16/626,435

(22) PCT Filed: Jun. 26, 2018

(86) PCT No.: PCT/CA2018/050788
§ 371 (c)(1),
(2) Date: Dec. 24, 2019

(87) PCT Pub. No.: WO2019/000089
PCT Pub. Date: Jan. 3, 2019

(65) Prior Publication Data

US 2020/0162808 A1 May 21, 2020

Related U.S. Application Data

(60) Provisional application No. 62/524,873, filed on Jun. 26, 2017.

(51) Int. Cl.

| | |
|---|---|
| ***H04R 5/02*** | (2006.01) |
| ***H04R 1/10*** | (2006.01) |
| ***H04R 3/04*** | (2006.01) |

(52) U.S. Cl.
CPC ..... *H04R 1/1083* (2013.01); *H04R 1/1016* (2013.01); *H04R 3/04* (2013.01); *H04R 2460/15* (2013.01)

(58) Field of Classification Search
CPC ..... H04R 1/1083; H04R 1/1016; H04R 3/04
See application file for complete search history.

(56) References Cited

U.S. PATENT DOCUMENTS 6,567,524 B1 5/2003 Svean et al.
6,687,377 B2 2/2004 Voix et al.
(Continued)

OTHER PUBLICATIONS

International Search Report dated Oct. 2, 2018 from the corresponding International Patent Application PCT/CA2018/050788.

*Primary Examiner* — Simon King
(74) *Attorney, Agent, or Firm* — Brouillette Legal Inc.; Robert Brouillette

(57) ABSTRACT

A system, device and method for assessing a fit quality of an earpiece while in use in a noisy environment. The earpiece having an external microphone for capturing an outer-ear audio signal and an internal microphone for capturing an inner-ear audio signal. The fit quality being assessed by estimating a filter according to the captured inner-ear and outer-ear audio signals, and determining a fit quality according to identified coefficients of the estimated filter. A system, device and method for assessing a seal quality of an earpiece while in use in a quiet environment. The earpiece having a loudspeaker for emitting a sound stimulus towards the ear canal and an internal microphone for capturing an audio signal inside the ear canal. The seal quality being assessed by estimating a transfer function according the emitted and captured sound stimulus, and determining at least one seal-quality indicator according to a signal magnitude of the transfer function.

20 Claims, 23 Drawing Sheets

(56) References Cited

U.S. PATENT DOCUMENTS

| | | | | |
|---|---|---|---|---|
| 7,688,983 | B2 | 3/2010 | Voix et al. | |
| 8,254,586 | B2 | 8/2012 | Voix et al. | |
| 8,254,587 | B2 | 8/2012 | Voix et al. | |
| 10,748,521 | B1 * | 8/2020 | Mulvey | G10K 11/17881 |
| 2009/0112051 | A1 * | 4/2009 | Miller, III | A61B 5/721 600/25 |
| 2009/0220096 | A1 * | 9/2009 | Usher | H03G 9/005 381/57 |
| 2013/0243227 | A1 * | 9/2013 | Kinsbergen | H04R 25/70 381/314 |
| 2015/0365776 | A1 | 12/2015 | Usher et al. | |
| 2016/0150330 | A1 * | 5/2016 | Niederberger | G10K 11/17854 381/314 |
| 2017/0150908 | A1 * | 6/2017 | Nadon | A61B 5/125 |
| 2018/0182371 | A1 * | 6/2018 | Thormundsson | G10K 11/17881 |
| 2019/0214038 | A1 * | 7/2019 | Bouserhal | G10L 25/84 |
| 2019/0253813 | A1 * | 8/2019 | Pedersen | H04R 25/652 |

* cited by examiner

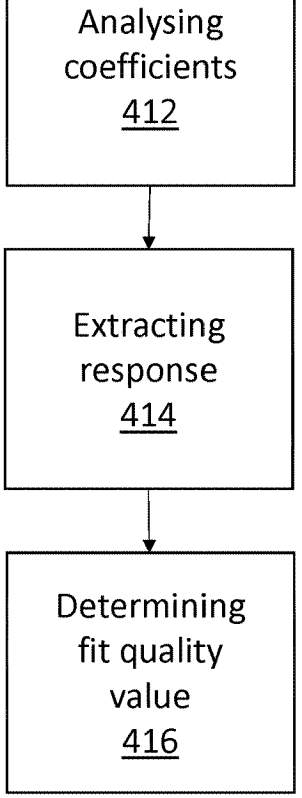
FIGURE 4F
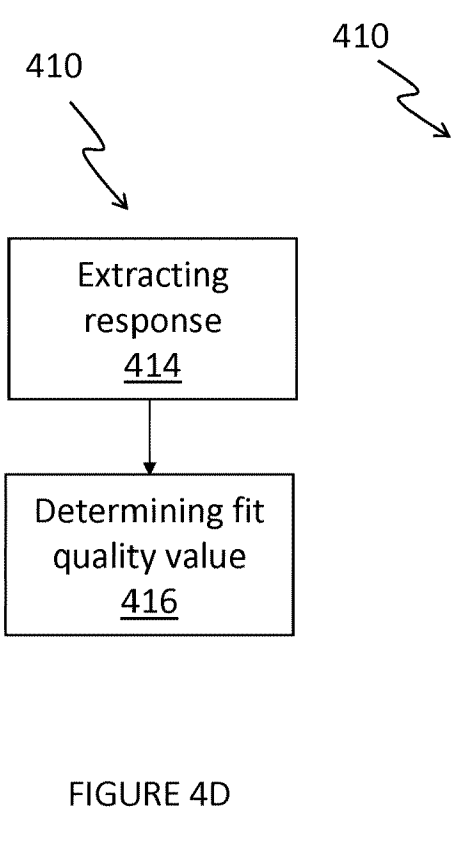
FIGURE 4E
FIGURE 4D
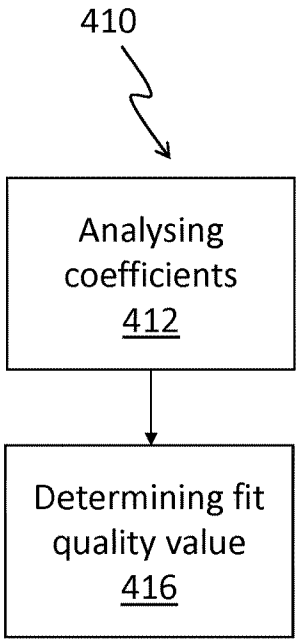
FIGURE 4C

622

| seal assessment frequency | signal magnitude | seal quality indicator |
|---|---|---|
| 150 Hz | -3 dB | no leak |
| 150 Hz | -12 dB | leak of r1 |
| 150 Hz | -15 dB | leak of r2 |
| 150 Hz | -21 dB | leak of r3 |
| 200 Hz | 0 dB | no leak |
| 200 Hz | -6 dB | leak of r1 |
| 200 Hz | -8 dB | leak of r2 |
| 200 Hz | -15 dB | leak of r3 |

650

800

900

1100

1200

1300

SYSTEM, DEVICE AND METHOD FOR ASSESSING A FIT QUALITY OF AN EARPIECE

CROSS-REFERENCE TO RELATED APPLICATIONS

The present patent application claims the benefit of priority of U.S. Provisional Patent Application No. 62/524,873 filed on Jun. 26, 2017 at the United States Patent and Trademark Office and entitled "System and Method of Continuous Assessment of a Fit of an In-Ear Wearable Device Using Digital Adaptive Filters".

FIELD OF THE INVENTION

The present invention generally relates to systems, devices and methods to assess a fit quality of an earpiece and more particularly to systems, devices and methods for assessing the fit quality of an earpiece when in a noisy or in a silent environment.

BACKGROUND OF THE INVENTION

Earpieces are used for various applications. For instance, the earpiece can be a Passive hearing protection devices (HPD) for protecting the wearer's audition from environmental noises or sounds. In another case, the earpiece can be a communication device for allowing two or more people to communicate in a noisy environment, for instance. Earpieces are indeed well known in the art. However, such devices are only effective if they are properly worn in order to provide a proper fit quality. This is particularly true for intra-aural or in-ear devices such as earplugs or circum-aural protector or communication devices. In the case of in-ear devices, the earpiece needs to be properly and carefully inserted inside the auditory ear canal to adequately protect the wearer's audition or allow proper communication. In the case of circum-aural protector or communication devices, the earpiece needs to properly cover and seal the ear pavilion in order to adequately protect the wearer's audition or allow proper communication. Also, in most cases, the earpiece needs to have a shape and size that is sufficiently adapted to the ear or ear-canal of the wearer. Moreover, when worn during a prolonged period, the fit quality of the earpiece can decrease as it can change position, loosen or deform over time, also over time, the materials of the earpiece can degrade and affect its fit quality. The fit quality of the earpiece decreases only gradually and is often unnoticed by the wearer. For instance, in the case of an earplug, the wearer cannot detect the loosening of the earplug device since his hearing naturally adapts to the gradually increasing noise entering the earpiece. Over the years, different "fit testing" solutions using different "fit-test" systems have been developed for earpieces to address the problem in order to ensure a proper fit quality and to provide the expected sound attenuation.

Such individual "fit testing" solutions generally provide great potential and advantages for hearing conservation. However, the performed measurements only indicate a "snapshot" of the sound attenuation provided by the earpiece at the time of measurement. Studies show that earplugs are not always consistently fitted and that earplugs may become loose when worn during a prolonged period, thereby requiring periodic repositioning. However, the need to periodically reposition the earplugs is often overlooked by the wearer. Indeed, the wearer is mostly preoccupied by his duties, and taking a short break in order to reposition his earplugs can be a burden, especially for workers that need to remove a body coverage such as a mask or gloves, or would need to wash their hands or step out of their working environment in order to reposition their earplugs. Moreover, the wearer often forgets to reposition his earplugs, since the wearer cannot notice that the attenuation level of his earplugs is decreasing. It can be even more of a burden and cumbersome for a worker to periodically step out of his working environment to perform an individual fit test in order to periodically assess a fit quality of his earplugs while worn. In fact, individual "fit testing" solutions are generally time-consuming and can be administratively challenging.

Another issue relates to the fact that measurements obtained by fit testing solutions, as with any metrological device, are inherently uncertain, i.e. the reported attenuation values may differ from the "true" physical attenuation. Such uncertainty should be reported or otherwise accounted for by the fit-test system so that the uncertainty may be taken into account by the operator, especially in applications requiring specific HPD noise attenuation. Several third-party independent validation studies have been conducted on existing commercial systems. Some studies report that some of the existing fit-test systems may present results that substantially differ from the sound attenuation measurement on a same person following standardized procedures such as the Real-Ear attenuation at Threshold (REAT) measurement prescribed in ISO 4869 or ANSI/ASA 512.6 standards. Such uncertainty may be drastically reduced by removing two major uncertainty components. One of the two major uncertainty components is the so-called "fit uncertainty" related to the fit/refit variability of a given earpiece by one user over time. The other one of the two major uncertainty components is generally referred to as the "spectrum uncertainty" resulting from the measurement of the sound attenuation in only one given noise spectrum, and not in the ambient noise to which the user is really exposed. Therefore, there is a need for a solution that can seamlessly assess a fit quality of an earpiece with adequate precision, while being worn in the working environment of the user. Technologies and methods for objective assessment of in-ear device acoustical performance have been disclosed in U.S. Pat. Nos. 7,688,983, 8,254,586 and 8,254,587. The technology uses an F-MIRE (Field Microphone-In-Real-Ear) approach. The F-MIRE approach simultaneously measures sound pressure levels in the ear canal under a hearing protector (in-ear microphone) and outside the hearing protector (outer ear microphone), the difference between those two measurements allow estimating the attenuation level of the hearing protector. This approach requires the computation of several Fast-Fourier Transforms (FFT), either for the computation of the auto-spectra of the in-ear microphone and outer-ear microphone (U.S. Pat. No. 6,687,377), or for the computation of the transfer function estimate using the aforementioned auto-spectra, as well as the cross-spectra (U.S. Pat. No. 7,688,983).

The F-MIRE approach, as disclosed in the U.S. Pat. Nos. 6,687,377 and 7,688,983, is computationally demanding and is only limited to an instantaneous assessment of the attenuation provided by an HPD and does not have the capacity to verify or ensure that the assessed attenuation is provided while the HPD is being worn during the following hours, days, weeks, etc.

Other technologies, such as the method disclosed in U.S. Pat. No. 6,567,524, provide in-ear wearable audio devices for protecting the ear while allowing communication/conversation in a noisy environment. Such technologies typically use an electroacoustic approach to assess a proper fit of the audio in-ear wearable device. This approach links the sound level played back using an internal miniature loudspeaker at the same sound level actually measured by the in-ear microphone. The relationship is measured in terms of magnitude and phase at different discrete frequencies and compared to a predetermined reference value that is indicative of a properly sealed earpiece. However, this method requires a calibration step that must be performed before assessing the seal quality. The assessed seal quality can be inaccurate if the earpiece is moved between the calibration step and the assessment step. Moreover, the seal quality assessment is not seamlessly provided, since a separate calibration step must be performed beforehand. There is thus a need for a solution to provide an assessment of a fit quality or a seal quality that is seamless to the user, that does not rely on intensive computation and that can operate in real-time while the earpiece is being used without requiring the user to step out of his environment and without requiring a separate calibration step.

SUMMARY OF THE INVENTION

The shortcomings of the prior art are generally mitigated by providing a system, device and method for seamlessly assessing a fit quality or a seal quality of an earpiece in order to determine an indicator of a sound attenuation level provided by the earpiece while it is being worn and in use.

It shall be recognized that an earpiece may be any type of HPD such as an earplug, a hearing aid (prostheses), a supra or circum-aural protector device or an earphone (in-ear audio wearable device) to either protect the ear, allow communication/conversation in a noisy environment or capture biosignals that are present in the occluded ear canal (ex.: heartbeat or breathing rate). Such earpieces are effective and provide an expected sound attenuation if the fit quality and seal quality of the earpiece is adequate while in use.

A skilled person will recognize that the fit quality or seal quality can be affected by the shape, size, position, integrity, degradation and pre-insertion manipulation of the earpiece. The fit quality and seal quality can be furthermore affected by various movements produced by the walls of the ear-canal. Indeed, as the user produces a jaw movement such as to speak, yawn or eat, the walls of the ear-canal can be provoked to move and affect a position or shape of the earpiece.

It should be understood that the term microphone used herein refers to any type of sound capturing device or means to capture sounds. Also, the terms loudspeakers and/or speakers refer to any type of sound emitting devices or any means to reproduce sound from a sound source.

Fit Quality in Noisy Environment

According to one aspect, there is an audio wearable device having an earpiece for operatively preventing environment sounds from entering an ear-canal of a user. The earpiece has an external microphone for capturing an outer-ear audio signal outside the ear-canal and an internal microphone for capturing an inner-ear audio signal inside the ear canal. The audio wearable device has a modelization module, a coefficient identifier and a fit quality assessor. The modelization module is adapted to estimate an attenuation model of the earpiece while in use in a noisy environment, according to the captured outer-ear audio signal and the captured inner-ear audio signal. Notice that the attenuation model is indicative of an acoustic filter. The coefficient identifier is adapted to identify a group of acoustic filter coefficients according to the attenuation model. The fit quality assessor is adapted to analyse the group of acoustic filter coefficients and determine at least one fit quality indicator according to the analysis. The identified group of filter coefficients may comprise at least one hundred coefficients at a sampling rate of 8 kHz. The group of filter coefficients may comprise at least one hundred fifty coefficients.

According to another aspect, there is a fit quality assessment system for an earpiece. The earpiece is configured to prevent environment noise from entering an ear-canal of a wearer and has an external microphone for capturing an outer-ear audio signal outside the ear-canal and an internal microphone for capturing an inner-ear audio signal inside the ear canal. The system has a first receiver, as second receiver, a modelization module, a coefficient identifier, a fit quality assessor and a fit quality communication module. The first receiver is adapted to receive the captured outer-ear audio signal. The second receiver is adapted to receive the captured inner-ear audio signal. The modelization module is adapted to connect to the first and second receivers and estimate an acoustic filter, according to the captured outer-ear audio signal and the captured inner-ear audio signal. The acoustic filter is indicative of an attenuation provided by the earpiece while in use in a noisy environment. The coefficient identifier is adapted to identify a group of filter coefficients according to the estimated acoustic filter. The fit quality assessor is adapted to analyse the group of filter coefficients and determine at least one fit quality indicator according to the analysis. The fit quality communication module is adapted to transmit a status information indicative of the fit quality indicator. The fit quality assessor further comprises an averaging module adapted to calculate an average of the frequency responses, each of the frequency responses being associated to at least one of a plurality of the groups of filter coefficients. The fit quality assessor further comprises a frequency response extractor adapted to calculate a frequency response over a predetermined group of frequency bands according to the acoustic filter coefficients. The predetermined group of frequency bands may be within a range of 150 Hz and 350 Hz.

According to yet another aspect, there is a method of assessing a fit quality of an earpiece. The earpiece is configured to prevent environment noise from entering an ear-canal of a wearer. The earpiece may comprise an external microphone for capturing an outer-ear sound signal outside the ear-canal and an internal microphone for capturing an inner-ear sound signal inside the ear canal. The method involves capturing an inner-ear sound signal and/or receiving an outer-ear sound signal, estimating a digital filter, identifying coefficients and determining a fit quality. The inner-ear sound signal may be received from the internal microphone. The outer-ear sound signal may be received from the external microphone. Notice that the received outer-ear sound signal is indicative of a noisy environment. The digital filter is estimated according to the received inner-ear sound signal and the received outer-ear sound signal. The identified coefficients are the coefficients of the estimated filter. The fit quality is determined according to the identified coefficients. The fit quality may be determined according to a filter reliability.

According to yet another aspect, there is a fit quality assessment system for an earpiece. The fit quality assessment system is configured to prevent environment noise from entering an ear-canal of a wearer. The earpiece comprises an external microphone for capturing an outer-ear audio signal outside the ear-canal and an internal microphone for capturing an inner-ear audio signal inside the ear canal. The system comprises a first receiver adapted to receive the captured outer-ear audio signal, a second receiver adapted to receive the captured inner-ear audio signal, a modelization module configured to connect to the first and second receivers and to estimate a filter indicative of an attenuation provided by the earpiece while in use in a noisy environment, the filter being estimated according to the captured outer-ear audio signal and to the captured inner-ear audio signal, a coefficient identifier configured to identify a group of filter coefficients according to the estimated filter, a fit quality assessor configured to analyse the group of filter coefficients and determine at least one fit quality indicator according to the analysis and a fit quality communication module configured to indicate a status information indicative of the fit quality indicator. The fit quality assessment system may comprise a frequency response extractor configured to calculate a frequency response over a predetermined range of frequency bands according to the group of filter coefficients. The fit quality assessor may comprise a fit quality determinator adapted to determine a fit quality indicator according to the comparison and the calculation. The fit quality communication module may be adapted to connect to a speaker of the earpiece and may be adapted to transmit the status information to the speaker. The fit quality communication module may be configured to transmit the status information to a monitoring module of the system.

Fit Quality in Silent Environment

According to one aspect, there is an audio wearable device having an earpiece. The earpiece is adapted to operatively prevent environment sounds from entering an ear-canal of a user. The earpiece comprises a sound emitting device, such as a loudspeaker, for emitting sounds towards the ear canal and a sound capturing device, such as an internal microphone, for capturing an inner-ear audio signal inside the ear canal. The audio wearable device comprises as sound source generator, a sound source transmitter, a modelization module, a signal magnitude identifier and a seal quality assessor. The sound source generator is adapted to generate a sound stimulus at a predetermined seal assessment frequency. The sound source transmitter is adapted to transmit the sound stimulus to the loudspeaker and the modelization module. The modelization module is adapted to estimate a transfer function of the earpiece while in use in a silent environment, according to a comparison of the sound stimulus and the inner-ear audio signal of the sound stimulus as captured by the internal microphone. The signal magnitude identifier is adapted to establish a signal magnitude of the transfer function at the predetermined seal assessment frequency. The seal quality assessor is adapted to determine at least one seal-quality indicator according to the signal magnitude. The predetermined seal assessment frequency may be between about 100 Hz and about 200 Hz. The predetermined seal assessment frequency may be between about 2000 Hz and about 5000 Hz. The sound source generator may be configured to generate a sound stimulus at a plurality of predetermined seal assessment frequencies. The signal magnitude identifier may be further configured to establish a plurality of signal magnitudes according to the transfer function and the plurality of predetermined seal assessment frequencies and the seal quality assessor may be adapted to determine at least one seal-quality indicator according to the plurality of signal magnitudes. The sound source generator may be further adapted to generate a plurality of sound stimuli at predetermined otoacoustic emissions measurement calibration frequencies. The predetermined seal assessment frequency may be one of the otoacoustic emissions measurement calibration frequencies. The plurality of sound stimuli may comprise two pure tone frequencies. The device further comprising a seal quality communication module adapted to transmit a status information that is indicative of the at least one seal quality indicator. The status information may be transmitted to the sound emitting device or a monitoring system. The at least one seal-quality indicator may be a leak indicator selected from a group consisting of a leak radius size, a leak length and a leak volume. The sound emitting device may be a loudspeaker. The sound capturing device may be an internal microphone.

According to another aspect, there is a seal quality assessment system for an earpiece. The earpiece is configured to prevent environment noise from entering an ear-canal of a wearer. The earpiece comprises a sound emitting device, such as a loudspeaker, for emitting sounds towards the ear canal and a sound capturing device, such as an internal microphone for capturing an inner-ear audio signal inside the ear canal. The seal quality assessment system comprises a sound source generator, a sound source transmitter, a receiver, a modelization module, a signal magnitude identifier and a seal quality assessor. The sound source generator is adapted to generate a sound stimulus at a predetermined seal assessment frequency. The sound source transmitter is adapted to transmit the sound stimulus to the loudspeaker and the modelization module. The receiver is adapted to receive the inner-ear audio signal of the sound stimulus as captured by the internal microphone. The modelization module is adapted to estimate a transfer function of the earpiece while in use in a silent environment, according to a comparison of the sound stimulus and the received inner-ear audio signal. The signal magnitude identifier is adapted to establish a signal magnitude of the transfer function at the predetermined seal assessment frequency. The seal quality assessor is adapted to determine at least one seal-quality indicator according to the signal magnitude. The predetermined seal assessment frequency may be between about 100 Hz and about 200 Hz. The predetermined seal assessment frequency may be between about 2000 Hz and about 5000 Hz. The sound source generator may be configured to generate a sound stimulus at a plurality of predetermined seal assessment frequencies. The signal magnitude identifier may be further configured to establish a plurality of signal magnitudes according to the transfer function and the plurality of predetermined seal assessment frequencies and the seal quality assessor may be adapted to determine at least one seal-quality indicator according to the plurality of signal magnitudes. The sound source generator may be further adapted to generate a plurality of sound stimuli at predetermined otoacoustic emissions measurement calibration frequencies. The predetermined seal assessment frequency may be one of the otoacoustic emissions measurement calibration frequencies. The plurality of sound stimuli may comprise two pure tone frequencies. The device further comprising a seal quality communication module adapted to transmit a status information that is indicative of the at least one seal quality indicator. The status information may be transmitted to the sound emitting device or a monitoring system. The at least one seal-quality indicator may be a leak indicator selected from a group consisting of a leak radius size, a leak length and a leak volume. The sound emitting device may be a loudspeaker. The sound capturing device may be an internal microphone.

According to yet another aspect, there is a method of assessing a seal quality of an earpiece. The earpiece is configured to prevent environment noise from entering an ear-canal of a wearer. As an example, the earpiece may comprise a loudspeaker for emitting sounds towards the ear canal and/or an internal microphone for capturing an inner-ear audio signal inside the ear canal. The method of assessing a seal quality involves generating a sound stimulus, emitting the sound stimulus, capturing the inner-ear audio signal, comparing the generated sound stimulus, estimating a transfer function, identifying a signal magnitude and determining at least one seal-quality indicator. The sound stimulus is generated at a predetermined seal assessment frequency. The sound stimulus is emitted towards the ear canal. The received inner-ear audio signal is the inner-ear audio signal of the sound stimulus as captured by the internal microphone. The generated sound stimulus is compared with the received inner-ear audio signal. The transfer function is estimated according to the comparison. The identified signal magnitude is the signal magnitude of the transfer function at the predetermined seal assessment frequency. The at least one seal-quality indicator is determined according to the signal magnitude. The at least one seal-quality indicator may be determined according to a dataset of previously measured seal quality indicators. The sound stimuli may be generated at a plurality of predetermined seal assessment frequencies. The plurality of signal magnitudes may be identified according to the transfer function and the plurality of predetermined seal assessment frequencies. A plurality of sound stimuli may be generated at predetermined otoacoustic emissions measurement calibration frequencies. The plurality of sound stimuli may comprise two pure tone frequencies. A status information that is indicative of the at least one seal quality indicator may be transmitted. The status information may be transmitted to a monitoring device.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which:

FIG. 4C is a block diagram of the method for determining a fit quality indicator of FIGS. 4A and 4B by analysing coefficients, according to an alternate embodiment;

FIG. 4D is a block diagram of the method for determining a fit quality indicator of FIGS. 4A and 4B by extracting a response, according to an alternate embodiment;

FIG. 4E is a block diagram of the method for determining a fit quality indicator of FIGS. 4A and 4B by analysing coefficients and extracting a response, according to an alternate embodiment;

FIG. 4F is a block diagram of a method for assessing a fit quality, the method includes determining a fit quality indicator and communicating a fit quality indicator.

DETAILED DESCRIPTION OF THE PREFERRED EMBODIMENT

A System, device and method for assessing a fit quality of an earpiece will be described hereinafter. Although the system, device and method are described in terms of specific illustrative embodiments, it shall be understood that the embodiments described herein are by way of example only and that the scope of the device and method is not intended to be limited thereby.

For instance, it shall be recognized that a fit quality can be indicative of an earpiece position, seal, shape, deformation, deterioration, integrity, porosity, etc.

Fit Quality When in a Noisy Environment

Figure 1A:
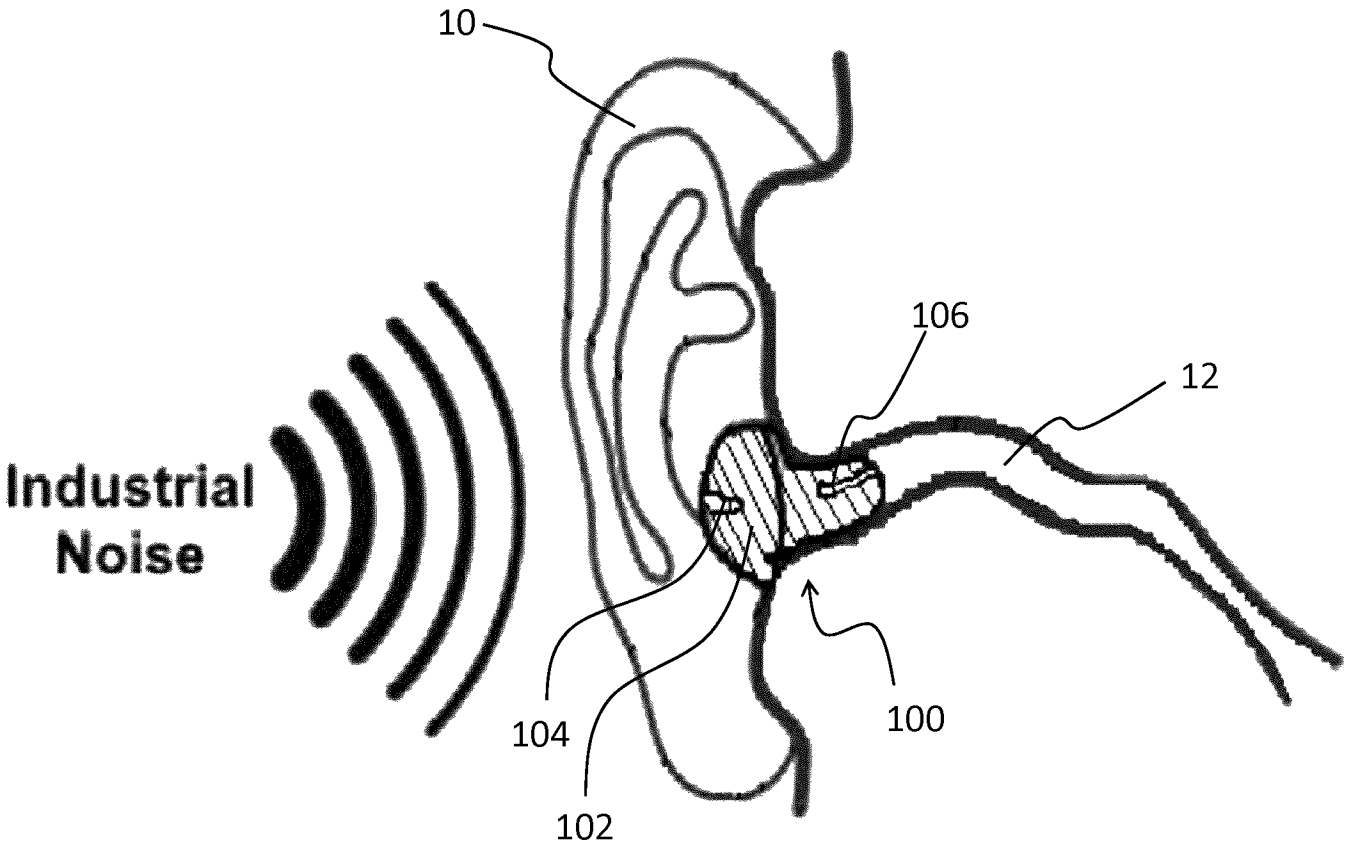
FIG. 1A is an illustration of an embodiment of an audio wearable device having an earpiece placed into an ear-canal entry of a wearer, the earpiece has an outer-ear microphone and an inner-ear microphone for assessing a fit quality of the earpiece when worn in a noisy environment.

Referring first to FIG. 1A, there is an embodiment of a device 100 for assessing a fit quality of an earpiece 102. The device 100 comprises an earpiece 102 such as but not limited to an earplug, intra-aural device or any other type of device adapted to prevent sounds or noises from accessing the auditory ear canal 12 of a user's ear 10. The earpiece 102 further comprises an external microphone (OEM) 104 and an internal microphone (IEM) 106 positioned and oriented to capture sounds outside and inside the ear canal, respectively. In fact, the earpiece 102 acts as a sound barrier between the external microphone 104 and the internal microphone 106.

In more detail, the external microphone (OEM) 104 is adapted to capture an outer-ear audio signal such as sounds or noises outside of the ear 10 or outside the ear canal 12, depending of the type of earpiece 102. The internal microphone (IEM) 106 is adapted to capture an inner-ear audio signal such as sounds or noises underneath or behind the earpiece 102 (inside the ear-canal), in the auditory ear canal 12 or ear cavity, depending of the type of earpiece 102. According to one embodiment, the outer-ear audio signal and the inner-ear audio signal are simultaneously captured in the presence of ambient noise.

The signal captured by the external 104 and internal 106 microphones are fed to a modelization module 110 (shown in FIG. 1B) of the device 100, in order to determine an attenuation model of the earpiece 102 while in use (i.e. as it is being worn by the user). The modelization module 110 is adapted to determine an attenuation model of the earpiece 102 according to the captured outer-ear signal and the captured inner-ear signal.

According to one embodiment, the modelization module 110 is adapted to estimate a contribution of the outer-ear audio signal within the ear canal according to the captured inner-ear audio signal and the captured outer-ear audio signal. The contribution of the outer-ear audio signal within the ear canal is iteratively estimated by attempting to reduce a difference between the captured inner-ear audio signal and the estimated contribution of the outer-ear audio signal within the ear canal. The estimated contribution of the outer-ear audio signal within the ear canal is indicative of the attenuation model of the earpiece while in use.

According to one embodiment, the attenuation model of the earpiece is characterized by a filter and the modelization module is further adapted to determine the coefficients of the filter.

According to the determined coefficients of the filter, a fit quality assessor 120 of the device 100 is adapted to analyse the coefficients and determine at least one fit quality indicator according to the analysis. The fit quality assessor 120 indicates if the earpiece 102 is fitted correctly in the ear 10 of a user while in an environment producing noise, be it periodically or continuously, such as industrial noise. In one embodiment, a well-fitted earpiece 102 has filter coefficients within a predetermined matching envelope or the frequency response averages of specific bands are identified as being over or under predetermined levels.

It shall be recognized that the audio wearable device 100 can be adapted to assess a fit quality of an earpiece in real-time as the inner and outer-ear audio signals are being captured or following a certain delay. Moreover, the audio wearable device 100 can be adapted to provide a fit quality according to the inner-ear audio signal and the outer-ear audio signal that have been previously captured and recorded, in order to provide a fit quality indicator over a given period of time.

According to one embodiment, the device 100 comprises a processor 111 adapted to execute or control the modelization module 110 and the fit quality assessor 120. It shall be recognized that the processor 111 can be a Digital Signal Processor (DSP).

Disturbance Detector

Figure 1B:
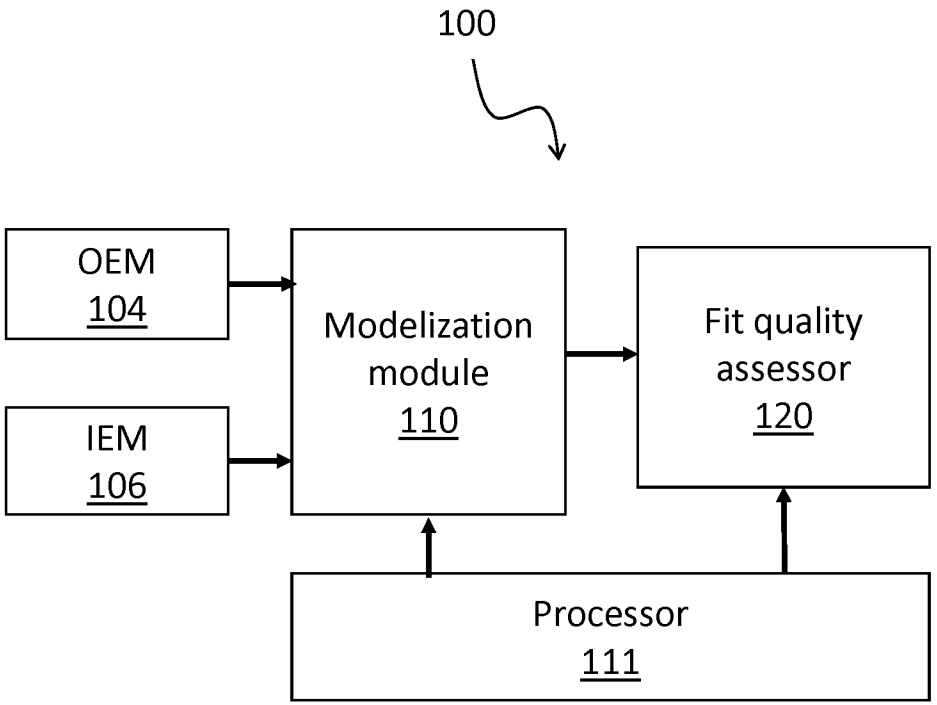
FIG. 1B is a block diagram of the components of the audio wearable device of FIG. 1A, the device comprising a modelization module and a fit quality assessor, according to one embodiment.
Figure 1D:
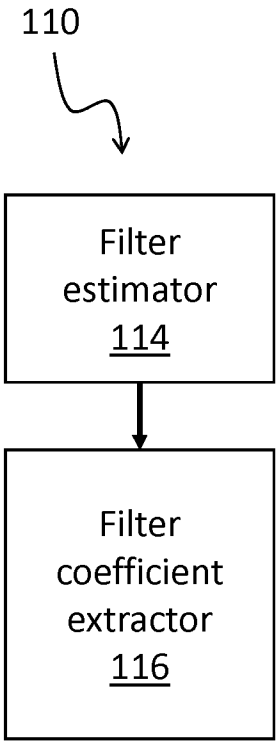
FIG. 1D is a block diagram of the components of the modelization module of FIGS. 1B and 1C, according to one embodiment.

Now referring to FIG. 1B, according to one embodiment, the signal captured by the internal microphone 106 and the external microphone 104 are received by a disturbance detector 112. The disturbance detector 112 uses as input the highest value of the filter coefficients determined by the modelization module 110 and provides an activation flag to the modelization module 110. If the difference between the highest filter coefficient of a current sample and the highest filter coefficient of a previous sample is below a predetermined threshold value, the associated filter to the current sample may be affected by some disturbance and the estimated filter of the current sample is considered as inaccurate and is not suitable for assessing a fit quality. Hence, in this case, the activation flag is negative and the modelization module will ignore the estimated filter and either reset the estimated filter or set the estimated filter to a previous state. A disturbance is generally understood as a component of the signal which may lead to diverging results of the modelization module 110. For instance, voice from the user, earpiece manipulation, non-vocal events produced by the user, or non-static transient sounds are generally considered as a disturbance. When disturbed, filter coefficients resulting from the adjustment of the coefficients might not accurately modelize the worn earpiece.

Modelization Module

Figure 1C:
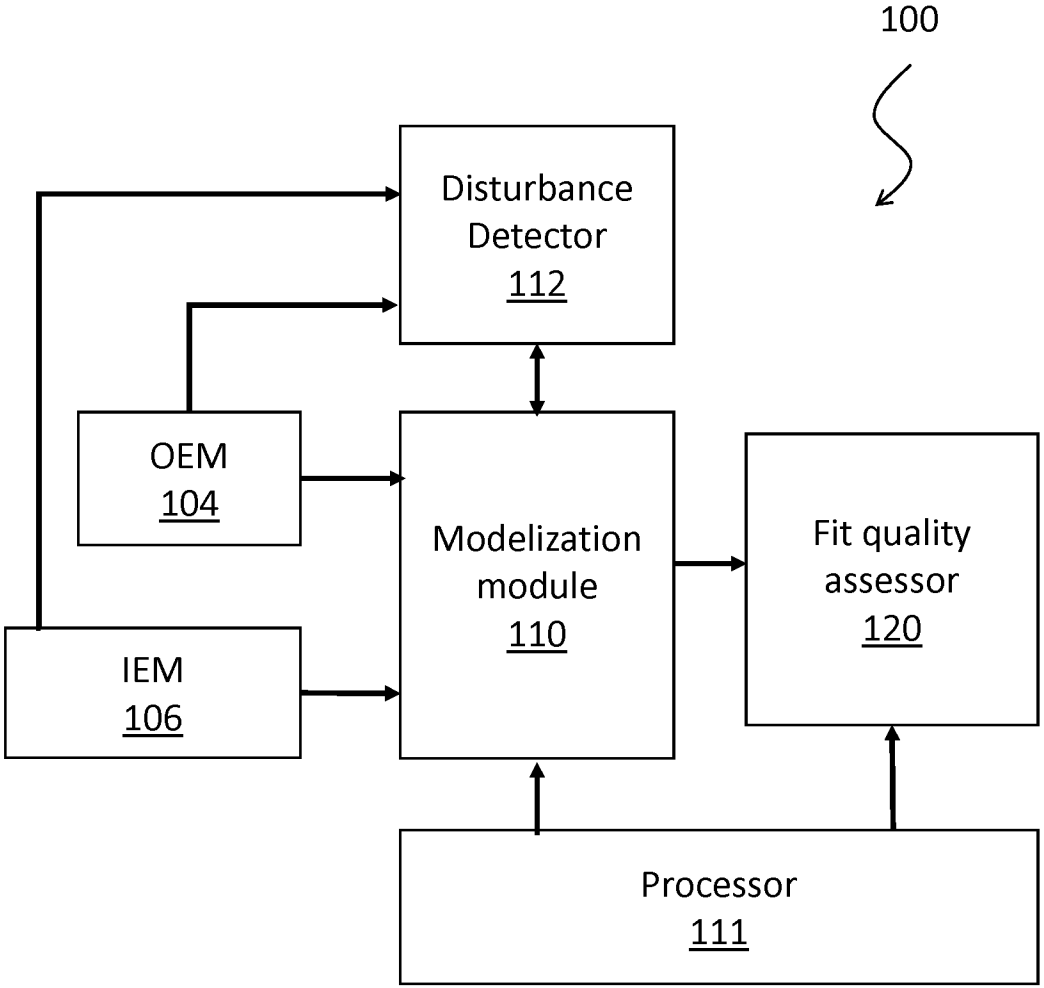
FIG. 1C is a block diagram of the components of the audio wearable device of FIG. 1A, the device comprising a modelization module, a fit quality assessor and a disturbance detector, according to an alternate embodiment.

Presented in FIG. 1C, according to one embodiment, the modelization module 110 comprises a filter estimator 114 and a filter coefficient identifier 116. The filter estimator 114 is configured to receive the captured outer-ear audio signal and the captured inner-ear audio signal, in order to adaptively estimate a filter according to the outer-ear audio signal and the inner-ear audio signal. According to one embodiment, the filter estimator 114 is configured to iteratively provide an estimation of an outer-ear audio signal contribution within the ear-canal, according to the captured outer-ear audio signal and the captured inner-ear audio signal. The estimation of the outer-ear audio signal contribution within the ear-canal is determined by iteratively comparing a preliminary estimation of the outer-ear audio signal contribution within the ear-canal with the captured inner-ear audio signal and modifying the preliminary estimation of the outer-ear audio signal contribution according to the comparison. Normally, after several iterations which could take about 2 seconds, the comparison between iteratively modified estimation of the outer-ear audio signal contribution within the ear-canal and the captured inner-ear audio signal indicates a similarity and the difference between the two signals converges towards zero. When the difference between the two signals converges towards zero, the filter estimator provides the iteratively modified estimation of the outer-ear audio signal contribution within the ear-canal as the estimated filter. Indeed, the filter is estimated by attempting to reduce an error between the captured inner-ear audio signal and the estimated outer-ear audio signal contribution within the ear-canal. The filter coefficient identifier 116 is adapted to identify the coefficients of the estimated filter.

According to one embodiment, the estimated filter is an adaptive filter such as a Normalized Least-Mean squares filter (nLMS). With a sampling rate of 8 kHz, the set of coefficients of the nLMS filter includes at least one-hundred coefficients or any number of suitable coefficients to accurately determine a fit quality indicator of the earpiece, at a given sampling rate. The coefficients are determined in real-time as the outer-ear signal and inner-ear signal are being captured or following a slight delay that is operatively unnoticeable to the user.

According to one embodiment, the adaptive filter is adapted to characterize the fit quality or the electroacoustic components of the earpiece 102 according to the outer-ear audio signal and the in-ear audio signal that are captured for de-noising the outer-ear audio signal such as when the digital filter is adapted to provide in-ear microphone speech enhancement. Indeed, the audio wearable device can use the adaptive filter computation for speech enhancement as well as for assessing a fit quality of the earpiece.

The proposed solution is adapted to provide an assessment of the fit quality of the earpiece on either a continuous, periodic or on demand basis. The digital filter may be configured to continuously, periodically or punctually (on demand) estimate the attenuation model of the earpiece while in use. The attenuation model being indicative of the impulse response of the acoustical path of the earpiece device, such as when the measured IEM or OEM signals have reached a given threshold of energy. The estimation provided by the modelization module 110 is ideally performed when the wearer is not speaking in order to estimate the acoustical path according to a passive attenuation of the earpiece 102.

The proposed method and system is therefore capable of seamlessly estimating an earpiece fit quality by way of a quick and simple determination of a filter according to captured inner-ear and outer-ear audio signals, while in a noisy environment.

Fit Quality Assessor

Figure 2C:
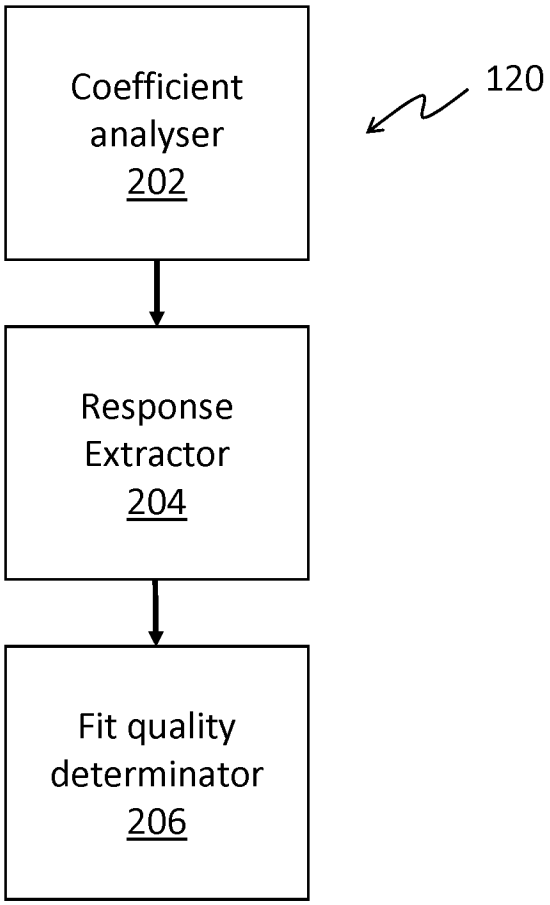
FIG. 2C is a block diagram of the components of the fit quality assessor of FIGS. 1B and 1C, the fit quality assessor has a coefficient analyser, a response extractor and a fit quality determinator, according to an alternate embodiment.
Figure 2B:
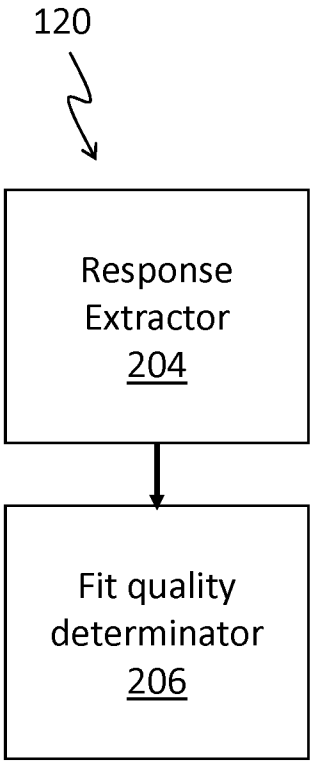
FIG. 2B is a block diagram of the components of the fit quality assessor of FIGS. 1B and 1C, the fit quality assessor has a response extractor and a fit quality determinator, according to an alternate embodiment.
Figure 2A:
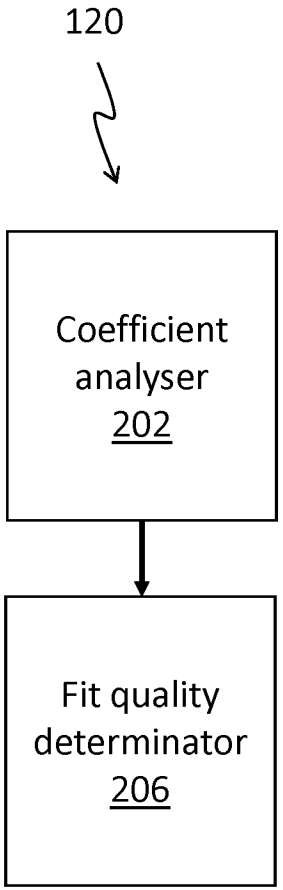
FIG. 2A is a block diagram of the components of the fit quality assessor of FIGS. 1B and 1C, the fit quality assessor has a coefficient analyser and a fit quality determinator, according to one embodiment.

According to one embodiment, as presented in FIG. 2A, the fit quality assessor 120 comprises a coefficient analyser 202 and a fit quality determinator 206. The coefficient analyser 202 is generally adapted to determine to which degree the coefficients of the filter are within a threshold envelope. If all the coefficients are within the threshold envelope, the fit quality determinator 206 determines a fit quality indicator indicative of a "good" fit quality. If a few of the coefficients are outside of the threshold envelope, the fit quality determinator 206 determines a fit quality indicator indicative of an "inconclusive" fit quality. However, if most of the coefficients are outside of the threshold envelope, the fit quality determinator 206 determines a fit quality indicator indicative of a "poor" fit quality.

It shall be recognized that the threshold envelope is a predetermined threshold envelope according to statistical analysis of previously acquired data.

Figure 3D:
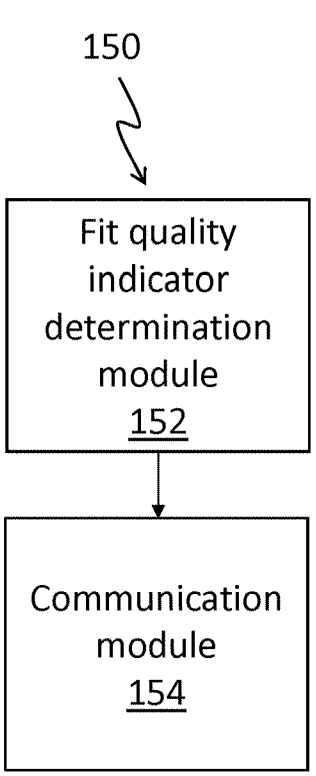
FIG. 3D is a block diagram of the components of a fit quality assessment system having a fit assessment module and a communication module, according to one embodiment.
Figure 3C:
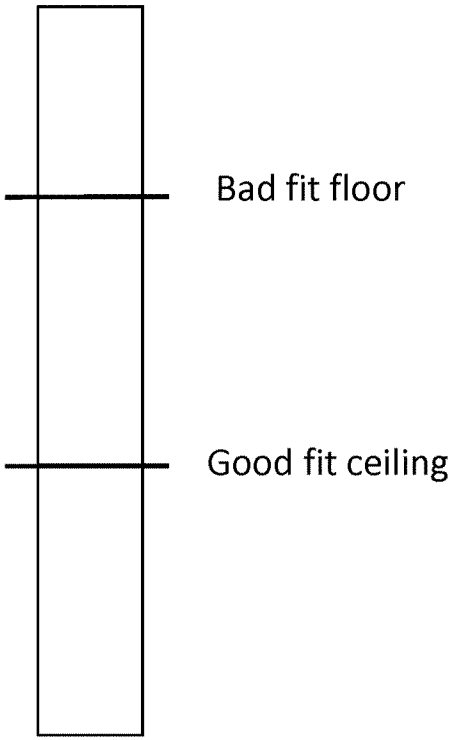
FIG. 3C is an illustration of a Bad fit floor and a Good fit ceiling used by the fit quality determinator of FIGS. 2B and 2C.
Figure 3B:
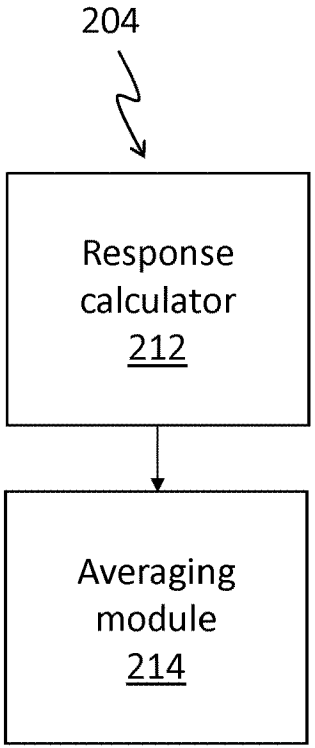
FIG. 3B is a block diagram of the components of the response extractor of FIGS. 2B and 2C, the response extractor has a response calculator and an averaging module, according to one embodiment.
Figure 3A:
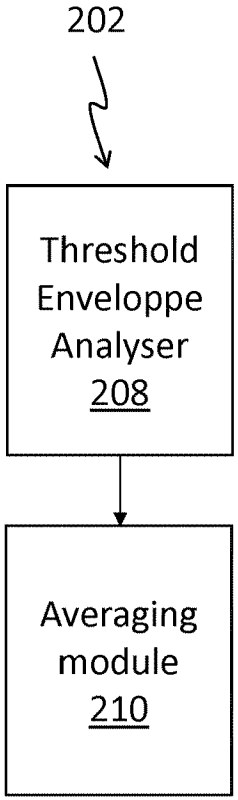
FIG. 3A is a block diagram of the components of the coefficient analyser of FIGS. 2A and 2C, the coefficient analyser has a threshold envelope analyser and an averaging module, according to one embodiment.

According to one embodiment, as presented in FIG. 3A, the coefficient analyser 202 receives several sets of filter coefficients and is adapted to determine to which degree the filter coefficients are within the threshold envelope with a threshold envelope analyser 208. The coefficient analyser 202 then performs an average of the result with an averaging module 210. The average of the result is then received by the fit quality determinator 206, in order to determine the fit quality indicator with greater accuracy.

According to one embodiment, the filter is a FIR-Filter, as presented in FIG. 2B, the fit quality assessor 120 has a frequency response extractor 204 and a fit quality determinator 206. The frequency response extractor 204 is adapted to calculate or extract a frequency response over a predetermined range of frequency bands or over a predetermined discrete frequency bands, such as between 150 Hz and 350 Hz, according to the coefficients of the FIR-Filter by calculating a FFT of the Impulse response. The fit quality determinator 206 determines a fit quality indicator according to an average of the extracted frequency response. For instance, as presented in FIG. 3C, if the average of the extracted frequency response is below a good fit ceiling threshold, the fit quality determinator 206 will determine a fit quality that is indicative of a "good" fit quality. If the average of the extracted frequency response is above a bad fit floor threshold, the fit quality determinator 206 will determine a fit quality indicative of a "bad" fit quality. Moreover, if the average of the extracted frequency response is between the bad fit floor and the good fit ceiling thresholds, the fit quality determinator 206 determines a fit quality indicator indicative of an inconclusive fit quality.

According to one embodiment, as presented in FIG. 3B, the response extractor 204 receives several sets of filter coefficients and is adapted to determine to which degree the calculated results for the frequencies associated to each set of coefficients are within the acceptable range with a response calculator 212. The response extractor 204 then performs an average of the calculated results with an averaging module 214. The average of the calculated result is then received by the fit quality determinator 206, in order to determine the fit quality indicator with greater accuracy.

According to one embodiment, as presented in FIG. 2C, the fit quality assessor 120 comprises a coefficient analyser 202, a response extractor 204 and a fit quality determinator 206. The fit quality determinator 206 is adapted to determine a fit quality indicator according to which degree the coefficients of the filter are within the threshold envelope and according to the calculated response at different predetermined frequencies associated to the filter.

It shall be recognized that the fit quality indicator determined by the fit quality determinator 206 can be presented in various forms and levels of precision. For instance, the fit quality determinator 206 can present the fit quality indicator according to a percentage value, a numeric value, a binary value, or any other type of value based on any number of suitable levels.

It shall further be recognized that once the fit quality indicator is determined 152, a communication module 154 can transmit a status information corresponding to the fit quality indicator to either the wearer or to a monitoring device or system, as presented in FIG. 3D.

According to another aspect, there is a method for assessing a fit quality 400. The method 400 includes receiving an inner-ear sound signal 402 and an outer-ear sound signal 404. The method further comprises determining a filter 406 according to the inner-ear sound signal and the outer-ear sound signal 404. Then identifying coefficients 408 of the filter and determining a fit quality according to the identified coefficients 410.

Figure 4B:
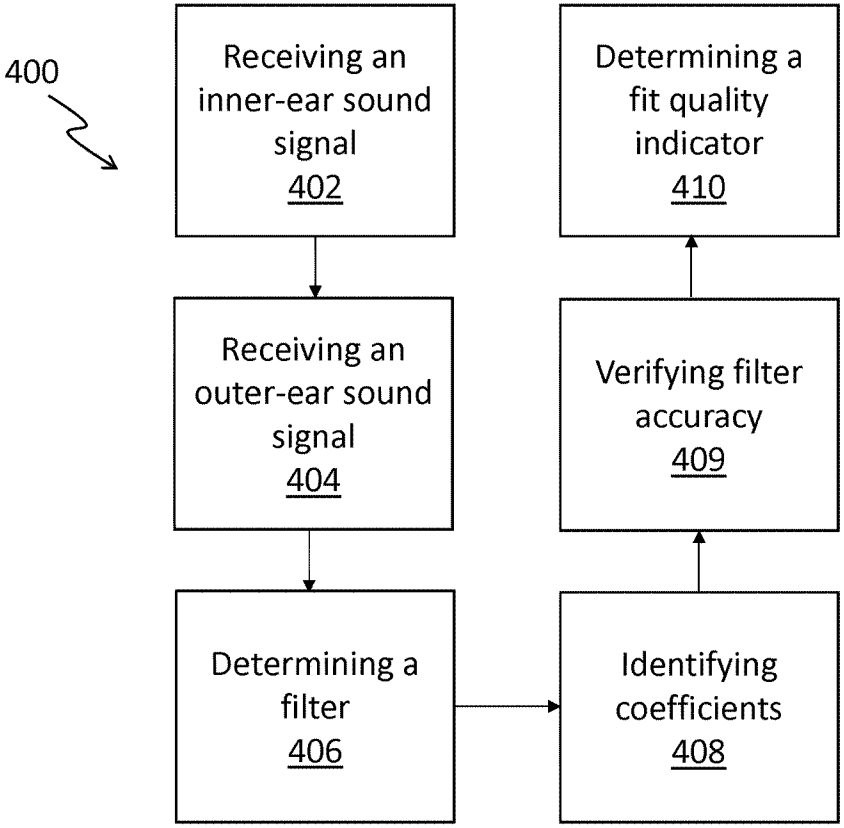
FIG. 4B is a block diagram of a method for determining a fit quality indicator by verifying a filter accuracy, according to an alternate embodiment.

According to another embodiment as presented in FIG. 4B, the method for assessing a fit quality 400 further includes verifying a filter accuracy 409 according to the identified coefficients. According to one embodiment, if the difference between the highest coefficients of two successive samples, respectively, is over a predetermine threshold, the filter is determined as being inaccurate due to a presence of speech, for instance.

Figure 4A:
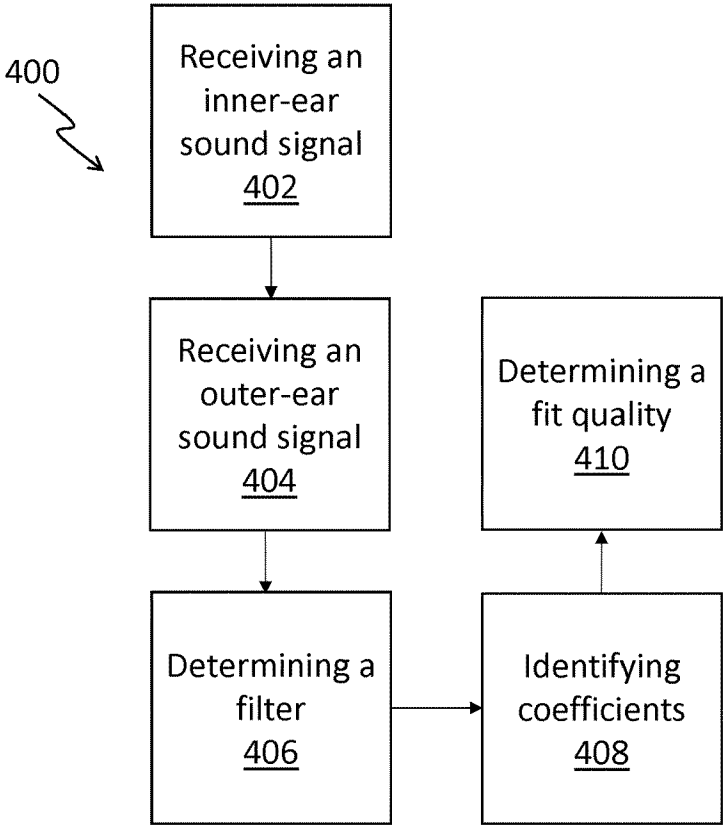
FIG. 4A is a block diagram of a method for determining a fit quality indicator, according to one embodiment.

It shall be recognized that the method for assessing a fit quality 400 as presented in FIGS. 4A and 4B can be implemented in various manners. For instance, determining a fit quality 410 can be performed by analysing the coefficients 412, as presented in FIG. 4C and/or extracting a frequency response 414, as presented in FIGS. 4D and 4E, in order to determine a fit quality 416. When both analysing the coefficients 412 and extracting a frequency response 414 are applied the fit quality can be determined 416 with greater accuracy than when only one of the analysing 412 or extracting 414 is applied.

It shall further be recognized that as presented in FIG. 4F, once the fit quality indicator is determined 416, the fit quality indicator can be communicated 452 to the wearer, to a monitoring device or system.

Figure 5A:
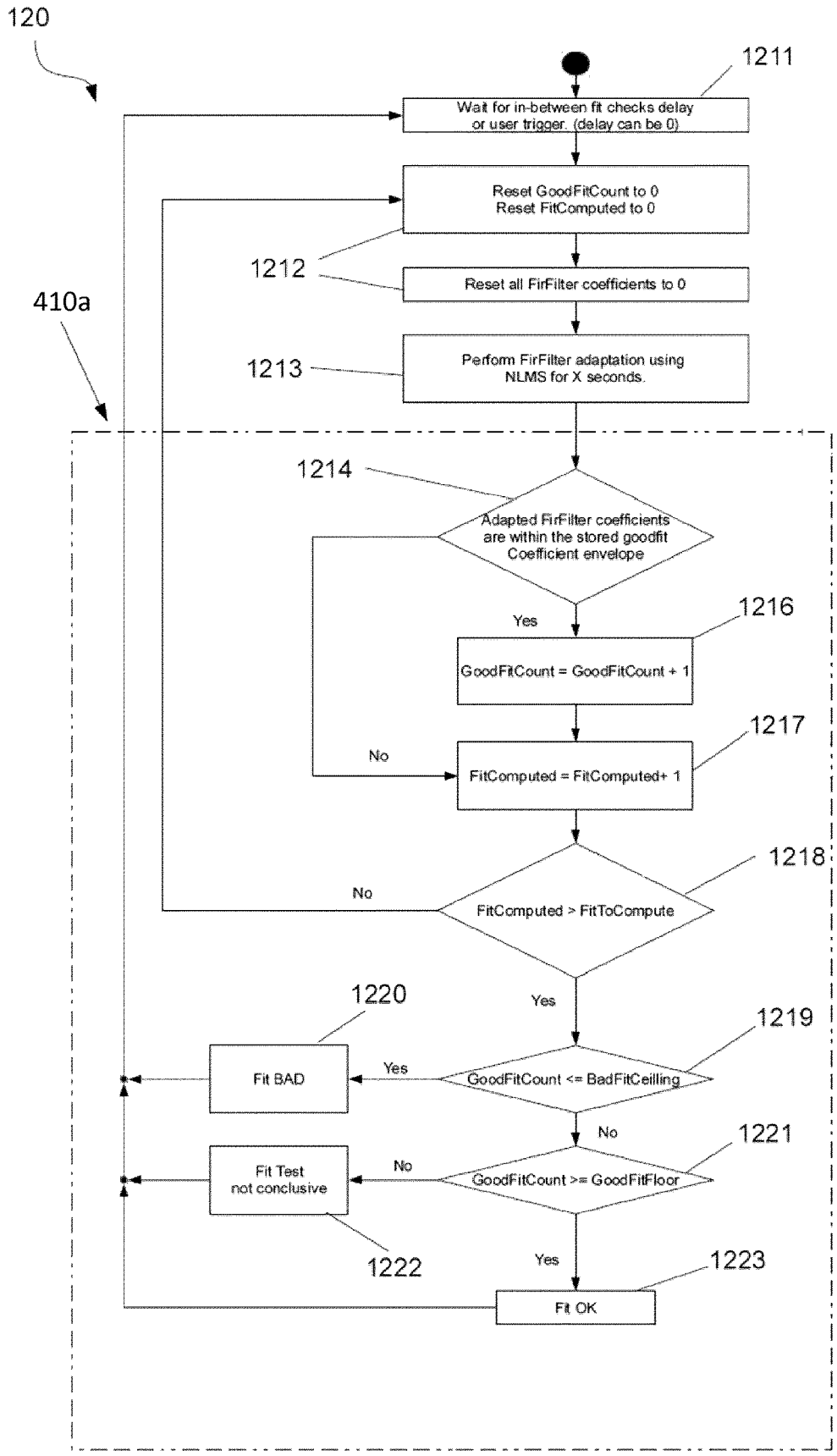
FIG. 5A is a flowchart of a method for assessing a fit quality of an earpiece by determining if filter coefficients are within a predetermined coefficients envelope, according one embodiment.

Presented in FIG. 5A is an implementation example for performing fit quality assessment 400 by analysing the coefficients 412, according to one embodiment. Based on the presence of the identified filter coefficients within one or more predetermined envelopes, a fit quality indicator is determined. In some embodiments, the method may further comprise averaging the filters coefficients 1214. The averaging step 1214 generally improves reliability of the calculation but is not essential.

Figure 5B:
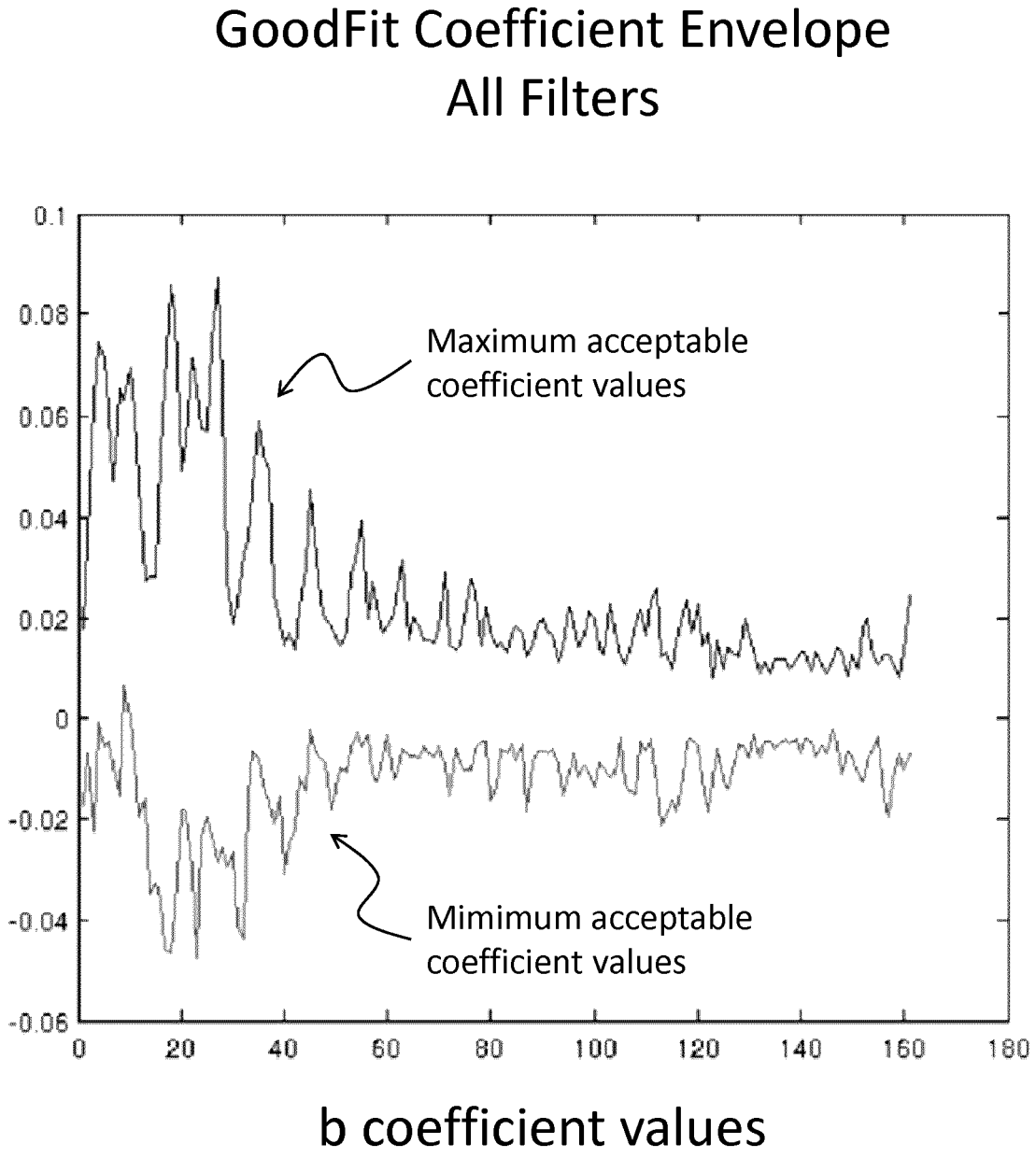
FIG. 5B is a diagram of a predetermined coefficients envelope used by the method of FIG. 5A, according one embodiment.

Presented in FIG. 5B, is an implementation example for performing fit quality assessment 400 by extracting a response 414, according to one embodiment. Extracting a response 414 may generally require more calculation and can be less efficient. However, extracting a response 414 allows to identify different types of disturbances with greater accuracy.

FIG. 5A presents a fit quality assessment method 400 by analysing coefficients 412, according to one embodiment. The method 1210 includes determining a FIR Filter coefficient 1213 according to the captured signals from the OEM 104 and the IEM 106 The method 400 may comprise waiting for a predetermined duration 1211. Such delay may ensure that previous value fit-check test is completed or may be triggered by a user. The method 400 further comprises initializing different counters and/or variables 1212, such as but not limited to a counter of calculated good fits, the number of fit tests processed and/or the filter coefficients values.

In a one embodiment, the method 400 further comprises performing filter adaptation using the adaptive filter 110 (nLMS) for a predetermined duration 1213.

The fit assertion method 400 as shown in FIG. 5A further comprises asserting the fit using coefficient envelopes 412. The method 400 comprises testing if the coefficients of the adaptive filter 110 are within an envelope of values 1214 associated with an acceptable or good fit of the earpiece 102. Presented in graph 1215 are the maximum and minimum thresholds for each coefficient value of a filter.

One method of verifying if a good fit is provided over a plurality of filters or samples is to count the number of good fit filters and determine if that number is acceptable. In cases where the identified filter coefficient values are within the predetermined envelope, a counter is incremented as another good fit filter 1216. If there are filters that remain to be analysed, the steps (1212 to 1217) are repeated with filter coefficient values of a next sample. When a predetermined number of filters to analyse is reached 1218, the number of good fit filters is compared to a BadFitCeiling number 1219 or to a GoodFitFloor 1221. If the number of good fit filters is below a BadFitCeiling then a "Bad Fit" is determined 1220. If the number of good fit filters is above a GoodFitFloor then a "Good Fit" is determined 1223. However, if the number of good fit filters is between the BadFitCeiling and the GoodFitFloor then an "Inconclusive Fit" is determined 1222

It shall be recognized that the number of filters to analyse 1218 can be any predetermined number of filters, be it a plurality of filters such as ten filters or only a single filter.

Referring to FIG. 5B, in another embodiment, the method 1230 uses response extraction 414 to calculate a frequency response at different predetermined frequencies. In some embodiments, the method may further comprise averaging the filters coefficients 1234. The averaging stage 1248 generally improves reliability of the calculation but is not essential. The method 414 generally requires more calculation or more processing power than the filter coefficients method 412. However, the response extraction method 414 can be more sensitive to different type of disturbances. One of the advantages of this method 414 is to provide a fit quality estimator (span of values) as opposed to the other method 412 which only provides a state or status as output.

For instance, as further presented in FIG. 5B according to one embodiment, the fit asserter module 120 is adapted to wait for predetermined time duration 1231. Such delay may ensure that a previous value fit-check test is completed or is triggered by a user. The fit asserter module 120 is further adapted to initialize different counters and/or variables 1232, such as but not limited to the frequency response average value and/or the filter coefficients values.

According to one embodiment, the fit asserter module 120 performs an adaptation of the filter 110 (nLMS) for a predetermined duration 1233 in order to estimate a filter.

Once the filter is estimated, the fit asserter module 120 is adapted to calculate a response at different predetermined frequencies 414. The method 414 comprises extracting frequency response of a group of predetermined bands 1234, such as between 150 and 350 Hz. Such extraction can be performed by the frequency response extractor module 204 of FIGS. 2B and 2C. The response extraction 1234 produces adapted coefficients by computing Fast-Fourier Transform (FFT) of the Impulse response.

The method 414 further comprises computing, for each response, the average of band responses (Band Average) 1235. Optionally, the method 414 may further determine a response coherence according to the received band responses (Coherency Curve) 1235, in order to detect a disturbance. In some embodiments, the method 414 may further verify if the calculated Coherency Curves are higher and/or over a threshold curve for all responses 1236. If the verification 1236 is negative, the response average and the filter coefficients are reset 1232, another filter is estimated 1233 and the frequency response is extracted to produce the filter coefficients 1234, then the average of the band responses is once again computed and the response coherence is determined 1235. If the verification 1236 is positive, the method 414 then verifies if an adaptive filter disturbance or inadequate audio environment is or are detected during adaptation 1237. If the verification 1237 is positive, the previous steps 1232 to 1235 (and optionally 1236) are repeated. If the verification 1237 is negative, the method 414 then inserts and/or adds the band average ("BandAverage") to the response average (ResponseAverage) 1238.

According to one embodiment, when a predetermined number of iterations is reached or when the response average contains a predetermined number of iterations 1239 ("Y" iterations"), the response average value can be used to assess a fit quality of the earpiece 102.

According to one embodiment, the method 414 verifies if the response average is higher than a predetermined value considered as being the lowest value ("bad fit floor") for a badly fitting configuration 1240. If the response average is higher than the predetermined value, the fit is considered bad or not acceptable 1241. The method 414 also verifies if the response average is below a predetermined value considered as being the highest value ("good fit ceiling") for a good fitting configuration 1244. If the response average is below the predetermined value, the fit quality is considered as being good or acceptable 1244. However, if the response average is between the "bad fit floor" and the "good fit ceiling", the fit quality of the earpiece 102 cannot be assessed and the method 414 is considered inconclusive 1240.

Figure 5C:
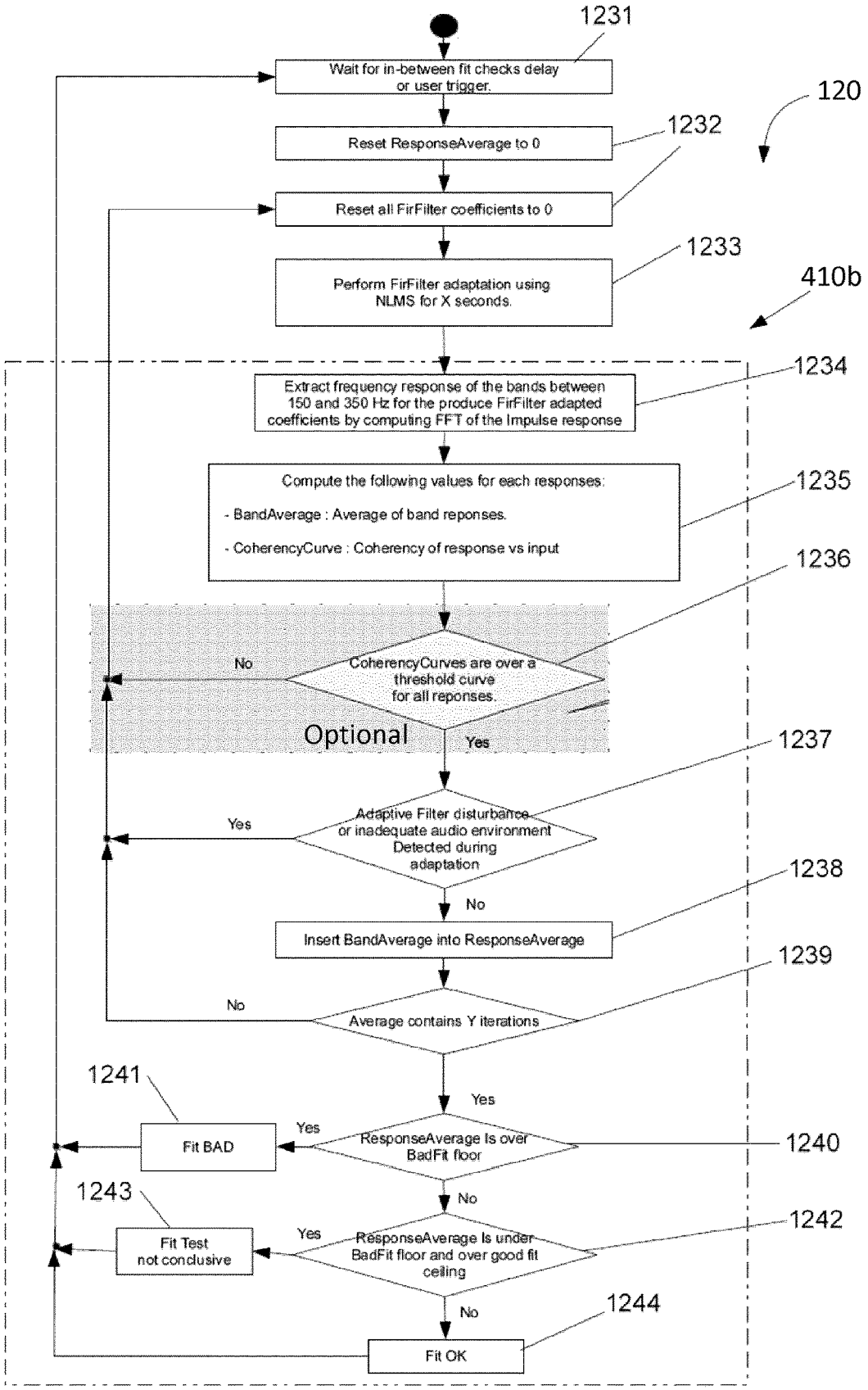
FIG. 5C is a flowchart of a method for assessing a fit quality of an earpiece by extracting frequency response at various predetermined frequencies, according to one embodiment.
Figure 5D:
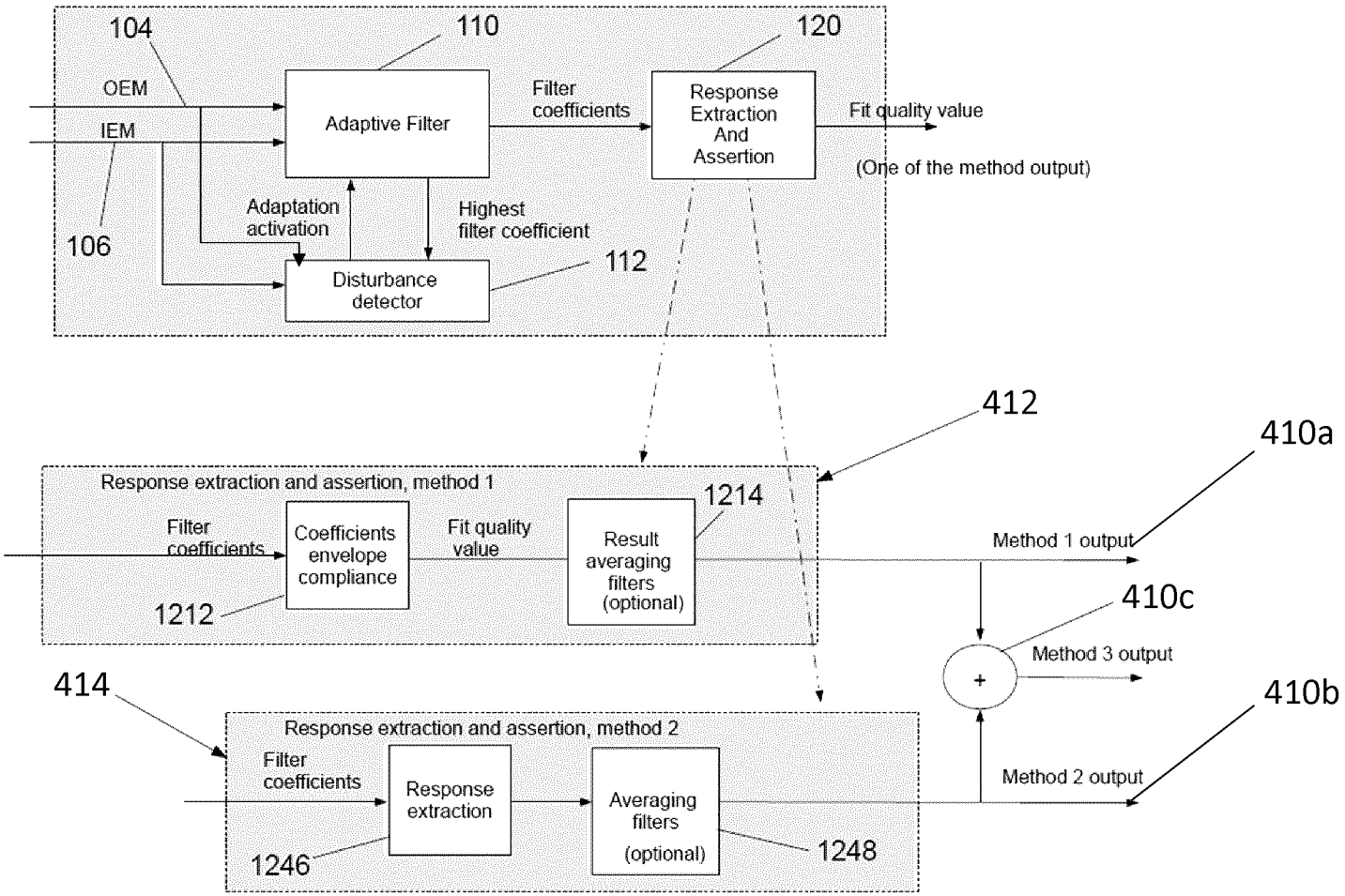
FIG. 5D is an illustration of a system for assessing a fit quality of an earpiece using digital adaptive filters, when in a silent environment, according to one embodiment.

Referring back to FIG. 5C, according to another embodiment there is a method 1250 that performs coefficient analysis method 412 and the response extraction method 414. According to one embodiment, the coefficient analysis method 412 and response extraction method 414 are performed in parallel to provide a real-time assertion of the earpiece 102 fitting. The method 1250 provides an assessment of the fit quality of an earpiece 102 with greater reliability or accuracy then when the response extraction method 414 or the coefficient analysis method 412 that are performed separately. A fit is considered as good or acceptable only if both methods 412 and 414 return an output value identifying a good or acceptable fit. The third method 1250 outputs a status of a bad or non-acceptable fit only if both the methods (412 and 414) return a bad or non-acceptable fit status ("BadFit"). In all other cases, the third method 1250 returns an inconclusive status or output.

The proposed method 400 of FIGS. 4A and 4B can be provided by a fit assessment system for an earpiece having an external microphone for capturing an outer-ear audio signal outside the ear-canal and an internal microphone for capturing an inner-ear audio signal inside the ear canal. The fit assessment system generally comprises a first receiver 104 adapted to receive the captured outer-ear audio signal and a second receiver 106 adapted to receive the captured inner-ear audio signal. The system further comprises a modelization module 110 adapted to connect to the first 104 and second 106 receivers and estimate a filter indicative of an attenuation provided by the earpiece 100 while in use in a noisy environment, according to the captured outer-ear audio signal and the captured inner-ear audio signal. The system also comprises a coefficient identifier adapted to identify a group of filter coefficients according to the estimated filter and a fit quality assessor adapted to analyse the group of filter coefficients and determine at least one fit quality indicator according to the analysis. The system has a fit quality communication module adapted to transmit a status information indicative of the fit quality indicator to the wearer or to a monitoring system.

Fit Quality When in a Silent Environment

According to another aspect there is an audio wearable device and a method for determining a seal quality of an earpiece of the device when in a silent or quiet environment. The present device and method allow evaluating in real-time a seal quality of an earpiece for adequate hearing protection or communication, or improving the signal-to-noise ratio for the distortion product otoacoustic emission (DPOAE) measurements.

According to one embodiment, the device and method allow to determine an earpiece seal quality and simultaneously calibrate stimuli according to otoacoustic emissions primary tones in order to perform otoacoustic measurements. Indeed, asserting a proper seal quality right before or during performing otoacoustic measurements can be beneficial since otoacoustic measurements must be performed with an earpiece providing a proper seal in order to obtain accurate measurements. However, it shall be recognized that the seal quality assessment method and device described herein can also be performed simply to assess the seal quality of the earpiece when in a quiet environment.

Figure 6A:
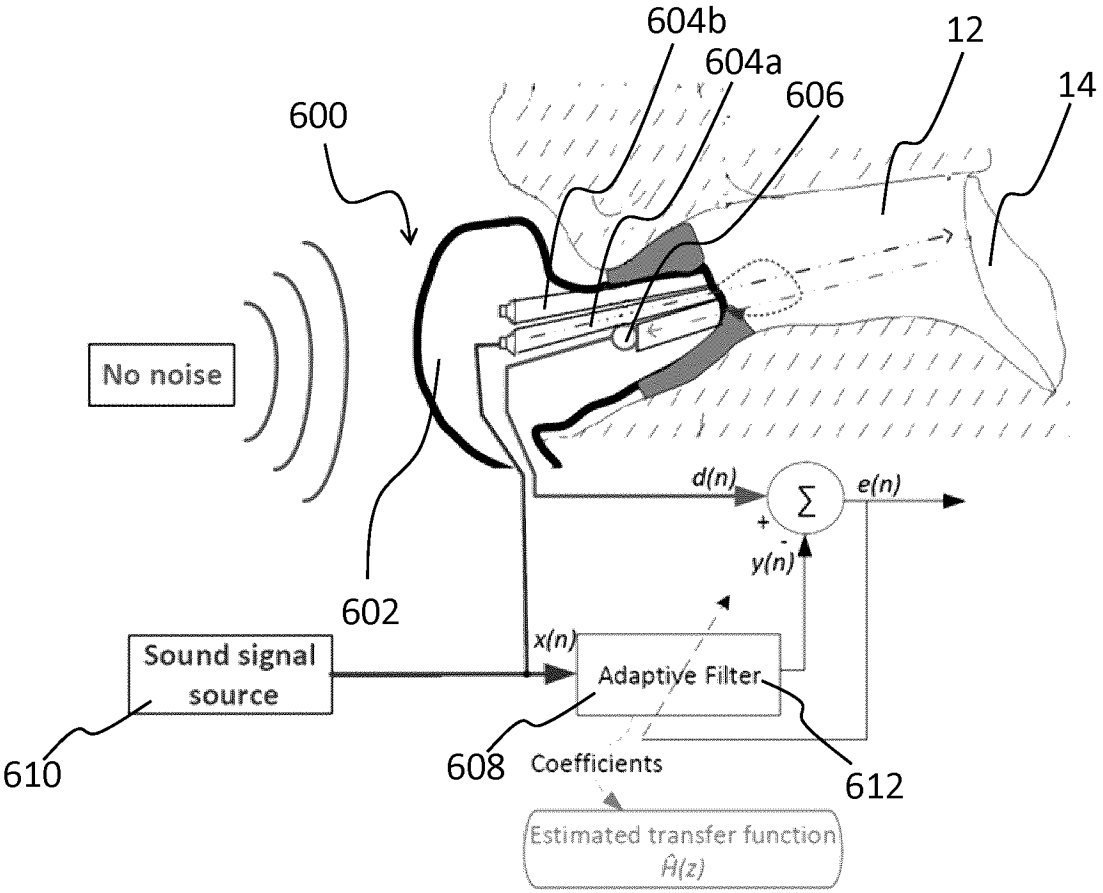
FIG. 6A is an illustration of an audio wearable device having an earpiece placed into an ear-canal entry of a wearer, the earpiece has a speaker and an inner-ear microphone for assessing a fit quality of the earpiece when worn in a silent environment, according to one embodiment.

Presented in FIG. 6A according to one embodiment, there is an audio wearable device 600 having an earpiece 602 such as but not limited to an earplug, intra-aural device or any other type of device for preventing sound or noise from entering the auditory ear canal 12. The earpiece 602 generally comprises two internal loudspeakers (SPK) (604*a* and 604*b*) positioned to emit two pure tone frequencies or stimuli towards the ear canal at known frequencies. One of the loudspeakers 604*a* is connected to a sound source 610 adapted to produce at least one of the two pure tone frequencies. When also performing an otoacoustic emissions measurement, the other loudspeaker 604*b* can be connected (not shown) to the sound source 610 and receive the other one of the two pure tone frequencies. The earpiece 602 also has an internal microphone (IEM) 606 positioned to capture a sound wave signal (i.e. otoacoustic emissions primary tones) generated inside the ear canal according to the stimuli. The device 600 also has a processor 608 such as a digital filter and is adapted to receive and process a measurement of the sound wave signal received by the IEM. The processor 608 is configured to compare the stimuli to the received signal and estimate a transfer function indicative of the seal quality. Understandably, the transfer function is also indicative of resonance magnitudes and anti-resonance magnitudes that are specific to the shape and volume of the ear canal (i.e. acoustics of the ear canal) as well as to the seal quality of the earpiece and earpiece acoustics, at a given frequency.

It shall be recognized that the sound wave signal generated inside the ear canal includes the stimuli and a reflected sound signal from inside the ear canal such as from the tympanic membrane 14, according to the stimuli. The characteristics of the reflected sound signal depends on the shape and volume of the ear canal, the earpiece acoustics and the earpiece seal quality.

It shall further be recognized that the received in-ear sound signal can be a signal having, for instance, a resonance or an anti-resonance, produced by the combination of the emitted stimuli and the reflected signals, at a given frequency. The received in-ear sound signal can further be a signal following a Helmholtz resonator model indicative of an improper seal of the earplug. Understandably, in the presence of a good seal quality, the Helmholtz resonator effect would not be present in the received in-ear sound signal.

It shall also be recognized that the two internal loudspeakers (604*a* and 604*b*) may be replaced by a single loudspeaker depending on the otoacoustic measurement method. Moreover, for the purpose of only assessing a fit quality in a silent environment, a single loudspeaker 604*a* connected the sound source 610 would be sufficient.

In one embodiment, in order to perform a Distortion Production Otoacoustic Emissions (DPOAE) measurement, the stimuli comprise at least frequencies between the range of 600 Hz to 7000 Hz. Note that the DPOAE are "responses when the cochlea is stimulated simultaneously by two pure tone frequencies", therefore each of the two speakers (604*a* and 604*b*) produce simultaneously one of the two pure tone frequencies. For instance, the stimuli may be a white noise or a chirp, i.e. sine sweep signal, having frequencies between the range of 600 Hz and 7000 Hz. The white noise or the chirp could have a duration of about 10 seconds or any other duration that is sufficient for allowing the processor to determine the transfer function. Notice that the processor determines the transfer function by comparing the stimuli to the received signal in order to converge to a minimal or acceptable error. It shall be recognized that the stimuli could be any other type of signal other than a white noise or a chirp, as long as the stimuli provides sufficient discrete frequencies within the required range of frequencies.

According to one embodiment, the IEM is associated to a conditioning circuit. The associated conditioning circuit has a high sensitivity and is adapted to detect sound pressure levels that are as low as −20 dB (SPL). Hence, the stimulus such as the white noise or the chirp can be produced at a very low sound level, such as at approximately 0 dB (SPL) and the IEM is still able to detect reflected sound wave signals generated inside the ear canal. In this case the stimulus is inaudible to the user and has a negligible effect on the cumulative noise dose for the user. Therefore, the present solution is adapted to continuously evaluate the seal quality of the earpiece as it is being worn when in a silent environment such as when performing audiometric measurements or before entering a noisy environment when the earpiece is used as a HPD (Hearing Protection Device).

According to one embodiment, the processor 608 is adapted to establish a group of signal magnitudes for various frequencies respectively, according to the transfer function. For instance, in order to calibrate the stimuli for distortion product otoacoustic emission (DPOAE) measurements, the processor is adapted to establish the signal magnitudes associated to frequencies that have a range between 600 Hz and 10 000 Hz. The processor is further adapted to establish the signal magnitudes associated to lower frequencies such as between a range of 100 Hz and 600 Hz, for evaluation of the seal quality. According to one embodiment, for seal quality evaluation, the signal magnitude needs only to be established for a single frequency such as 150 Hz or any other predetermined single or combination of frequencies that are known to clearly characterize a leak. For instance, as presented in the graph of FIG. 8, it can be noticed that at 150 Hz, the signal magnitudes differ depending on a "no leak" or a leak size radius ranging from $r_1$ to $r_3$. Therefore, the signal magnitude at 150 Hz can clearly characterize a leak. The processor is further adapted to determine a seal quality indicator according to the established signal magnitude.

It shall be recognized that the established set of signal magnitudes is indicative of a set of gain correction values to be applied at the various frequencies respectively, for otoacoustic emission stimuli.

According to one embodiment, the processor provides a seal quality indicator according to the transfer function. The seal quality indicator could be a PAR (Personal Attenuation Rating) indicator, a leak size indicator, a leak length indicator, a leak volume indicator, a fit quality indicator, or any other type of seal quality indicator.

It shall be understood that the device 600 does not require an external sound source. A better seal-quality assessment may be provided when performed in an environment without noise and while the user does not emit sounds. A single stimulus is emitted for a few seconds and the earpiece seal quality is thereby established according to the determined transfer function, while in a quiet environment.

Figure 6C:
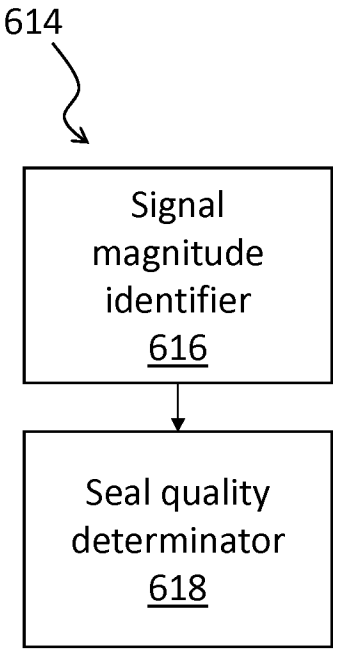
FIG. 6C is a block diagram of the components of the seal quality assessor of FIG. 6B, the seal quality assessor has a signal magnitude identifier and a seal quality determinator, according to one embodiment.
Figure 6B:
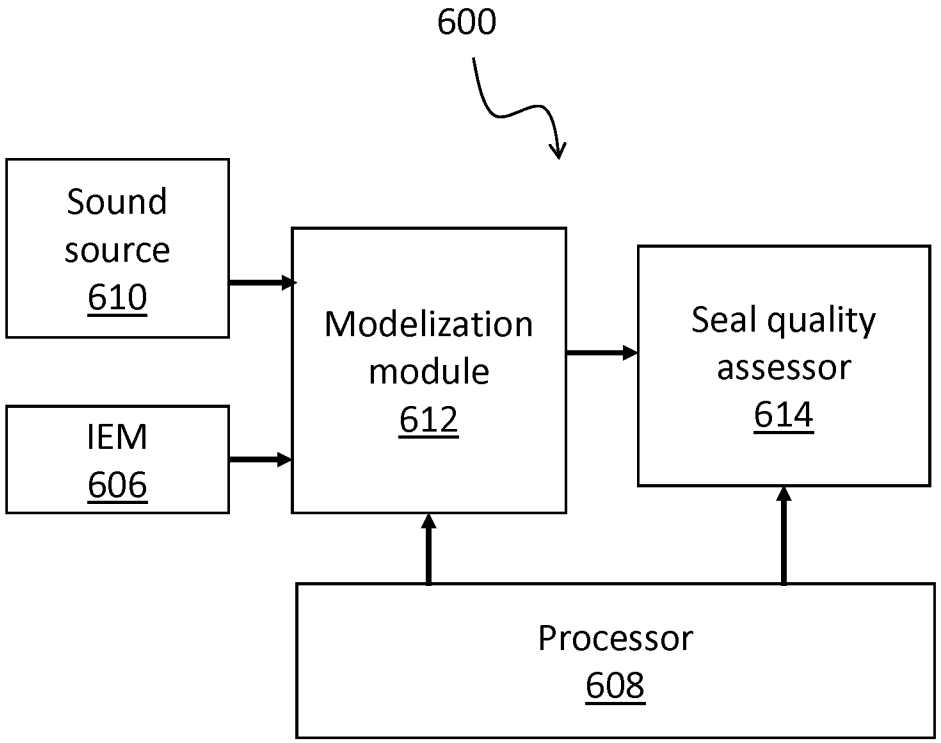
FIG. 6B is a block diagram of the components of the audio wearable device of FIG. 6A, the device has a modelization module and a seal quality assessor, according to one embodiment.

Presented in FIG. 6B are the various seal quality assessment components of the audio wearable device 600, according to one embodiment. The device 600 comprises a modelization module 612 adapted to determine a transfer function according to the stimuli produced by the sound source 610 and the signal as received by the internal ear microphone 606. The device 600 also comprises a seal quality assessor 614 generally adapted to determine a seal quality indicator according to the transfer function. As presented in FIG. 6C, the seal quality assessor 614 comprises a signal magnitude identifier 616 adapted to identify a signal magnitude at a predetermined seal assessment frequency. The predetermined seal assessment frequency is at least one frequency at which the signal magnitude of the transfer function is known to differ according to a seal quality. For instance, as presented in FIG. 8, it has been determined that at 150 Hz, the seal quality such as a leak size radius of the earpiece is identifiable according to the signal magnitude. A seal quality determinator 618 then determines a seal quality indicator according to an analysis, a calculation or according to a lookup table, such as the lookup table 622 of FIG. 6D. In the later case, the seal quality determinator 618 is adapted to compare the identified signal magnitude to reference signal magnitudes of the lookup table 622. The reference signal magnitudes being previously measured and stored in the lookup table 622 with associated seal quality indicators. The seal quality determinator 620 is adapted to determine a seal quality indicator corresponding to the identified signal magnitude and seal assessment frequency.

It shall be recognized that the signal magnitude identifier 616 can identify a plurality of signal magnitudes of the transfer function, each of the signal magnitudes corresponding to a different seal assessment frequency of a predetermined group of seal assessment frequencies. The seal quality determinator 618 then analyses the plurality of signal magnitudes and selects only one that corresponds to a most accurate seal quality indicator. The seal quality determinator 618 can also analyse the plurality of signal magnitudes, select the corresponding seal quality indicators and provide an average of the corresponding seal quality indicators to determine the seal quality indicator with greater accuracy.

Figures 6D, 6E:
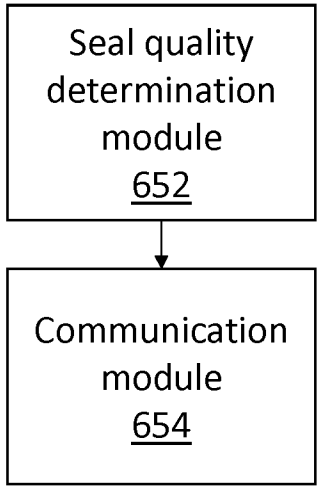
FIG. 6D is an illustration of a lookup table used by the seal quality determinator of FIG. 6C, according to one embodiment.
FIG. 6E is a block diagram of the components of a seal quality assessment system having a seal assessment module and a communication module, according to one embodiment.

It shall further be recognized that once the fit quality indicator is determined 652, a communication module 654 can transmit a status information corresponding to the fit quality indicator to either the wearer, the speaker (604*a* or 604*b*) or to a monitoring system, as presented in FIG. 6E.

Device Using Adaptive Filter

According to one embodiment of the device 600, the processor 608 may be adapted to execute instructions defined in the modelization module 612, as presented in FIG. 6A. In such an embodiment, the modelization module 612 is an adaptive filter. The filter module 612 is adapted to receive a stimuli signal from a sound source 610, referred herein as a reference x(n) signal input, and receives a captured signal by the IEM 606, referred herein as a desired d(n) signal input. It should be understood that the sound source 610 may be connected to the two loudspeakers 604*a* and 604*b* and may simultaneously produce two pure tone frequencies (e.g. one pure tone frequency per channel or loudspeaker) suitable for producing a DPOAE measurement. The filter module 612 uses the desired d(n) and reference x(n) signal inputs to identify the transfer function between electric signal of the loudspeakers (604*a* and 604*b*) and the signal captured by the IEM 606. The stimuli signal produced by the sound source 610 may consist of a low amplitude chirp or wide-band noise signal. Yet in other embodiments, the chirp could be reversed (high to low frequencies) to improve low frequency estimation, As further presented in FIG. 6A, the stimuli signal of the loudspeakers (604*a* and 604*b*) is used as the reference x(n) signal for the filter module 612 and the signal captured by the IEM 606 is used as the desired d(n) signal. According to one embodiment, the coefficients of the filter module 612 converges to a transfer function of the loudspeakers' (604*a* and 604*b*) response combined with the ear canal 12 and IEM 606 response based on the following equations (1) to (4):

$$y(n) = \hat{w}^T(n) \cdot x(n) \tag{1}$$

$$e(n) = d(n) - y(n) \tag{2}$$

$$\hat{w}(n+1) = \hat{w}(n) + \frac{\mu e(n) \cdot x(n)}{x^T(n) \cdot x(n)} \tag{3}$$

$$M(z) = \sum_{n=0}^{N} \hat{w}_n z^{-n} \tag{4}$$

The average of the transfer functions is generally referred as the estimated transfer function H(z). In this case, the adaptive filter 612 is a Normalized Least Mean Square (NLMS) adaptive filter and the magnitude response M(z) of the estimated seal transfer function H(z) is calculated from the NLMS coefficients using the equation (4) where $z=e^{j\omega}$, $\omega=2\pi f$, $\hat{w}$ are the NLMS coefficients and N is the number of coefficients for the NLMS adaptive filter. The magnitude M may further be estimated at a discrete frequency f, such as but not limited to f=150 Hz.

The magnitude M is generally used to evaluate the fit quality or the seal quality of the earpiece 602 but may further be used to calibrate the DPOAE stimuli signals $f=f_1$ and $f=f_2$. In embodiments using two loudspeakers (604*a* and 604*b*), when $f=f_2$, the sound source 610 signal is communicated to the second loudspeakers (604*a* and 604*b*). The calibration of the stimuli signals consists in adjusting the gain for the discrete primary tones based on the difference between 0 dB at 1000 Hz, as an example, and the magnitude at the discrete frequencies $f_1$ and/or $f_2$.

Method for Assessing a Seal-Quality

Figure 7B:
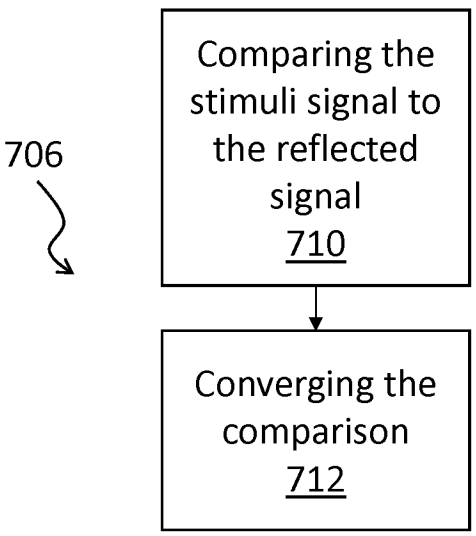
FIG. 7B is a block diagram of the method of estimating a transfer function of FIG. 7A by comparing the stimuli signal to the captured audio signal and by converging the comparison, according to one embodiment.
Figure 7A:
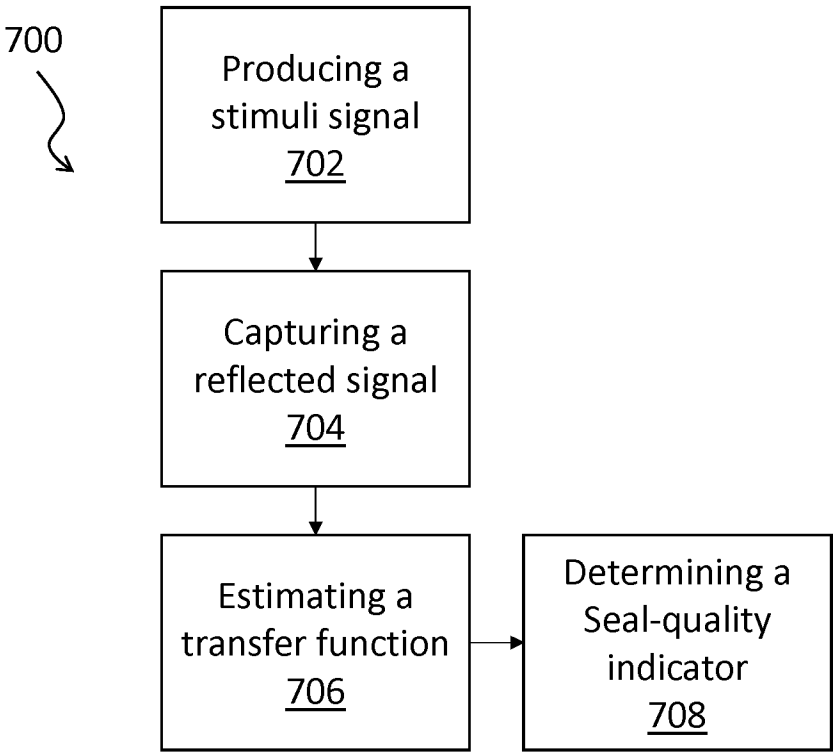
FIG. 7A is a block diagram of a method for assessing a fit quality of an earpiece having a loudspeaker and an inner-ear microphone by estimating a transfer function according to stimuli produced by the loudspeaker and audio signal as captured by the inner-ear microphone, when in a silent environment, according to one embodiment.

Presented in FIG. 7A is a method 700 for assessing a seal-quality of an earpiece 602, according to one embodiment. The method 700 generally comprises producing a stimuli signal 702 within an ear-canal and capturing a reflected signal 704 generated inside the ear canal according to the stimuli signal. The method further comprises estimating a transfer function 706 according to the produced stimuli signal and the captured signal. Then determining a seal-quality according to the transfer function 708.

It shall be recognized that the reflected signal generated inside the ear canal comprises the reflected sound signal from inside the ear canal according to the stimuli as well as the emitted stimuli signal. The characteristics of the reflected signal depends on the shape and volume of the ear canal, the earpiece acoustics and the earpiece seal quality. Moreover, reflected signal generated inside the ear canal can be a signal having, for instance, a resonance or an anti-resonance, produced by the combination of the produced stimuli and the reflected signals, at a given frequency. The reflected signal can further be a signal following a Helmholtz resonator model indicative of an improper seal of the earpiece. Notice that in the case of a good seal quality, the Helmholtz resonator effect would not be present in the reflected signal.

Presented in FIG. 7B is the method of estimating the transfer function 706, according to one embodiment. The method 706 comprises comparing the stimuli signal to the reflected signal 710 then estimating a transfer function that allows to converge the comparison to an acceptable error 712.

Figure 7E:
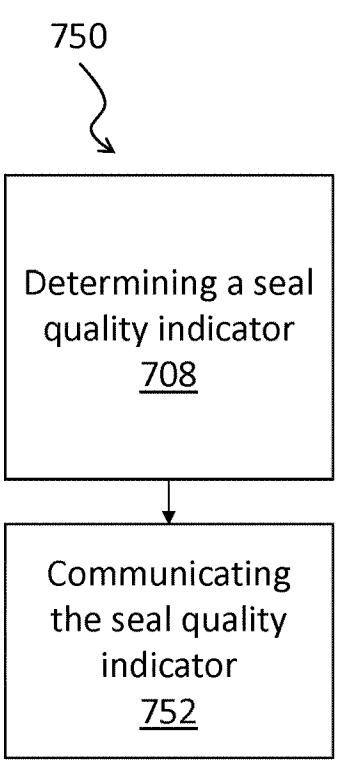
FIG. 7E is a block diagram of a method for assessing a seal quality, the method includes determining a seal quality indicator and communicating the seal quality indicator.
Figure 7D:
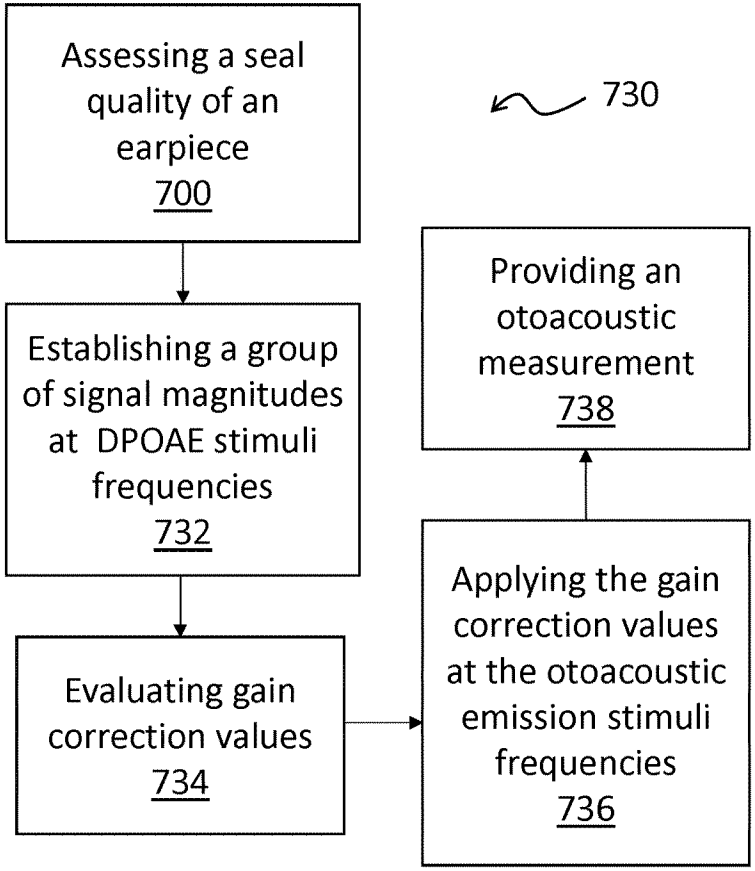
FIG. 7D is a block diagram of a method of providing an optoacoustic measurement following an assessment of a seal quality of an earpiece, according to one embodiment.
Figure 7C:
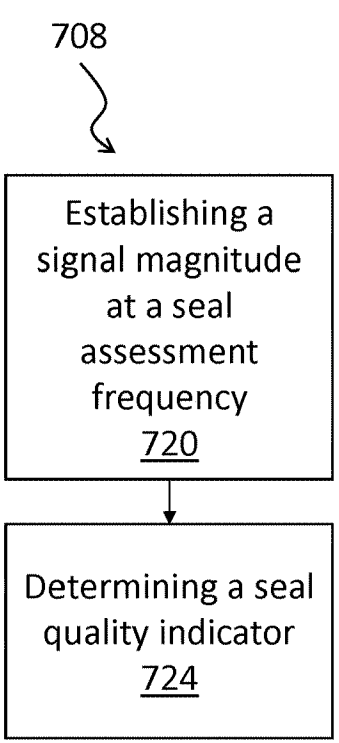
FIG. 7C is a block diagram of the method of determining a seal quality indicator of FIG. 7A by establishing a signal magnitude at a seal assessment frequency, according to one embodiment.

Presented in FIG. 7C is the method of determining a seal quality indicator 708, according to one embodiment. The method 708 comprises establishing a signal magnitude 720 associated to a predetermined seal assessment frequency, according to the estimated transfer function. Then determining a seal quality indicator 724 according to the established signal magnitude.

Presented in FIG. 7D is a method of performing an otoacoustic emissions measurement 730. The method 730 includes assessing a seal-quality of an earpiece 700. If the seal quality is good, the method 730 further includes establishing a group of signal magnitudes 732 associated to DPOAE stimuli frequencies, according to the estimated transfer function. Then evaluating gain correction values 734 according to the established group of signal magnitudes and applying the established gain correction values at the otoacoustic emission stimuli frequencies 736 in order to provide an otoacoustic measurement 738.

It shall be recognized that as presented in FIG. 7E, once the seal quality indicator is determined 708, the seal quality indicator can be communicated 752 to the wearer, to a monitoring device or system.

Some Results

Figure 8:
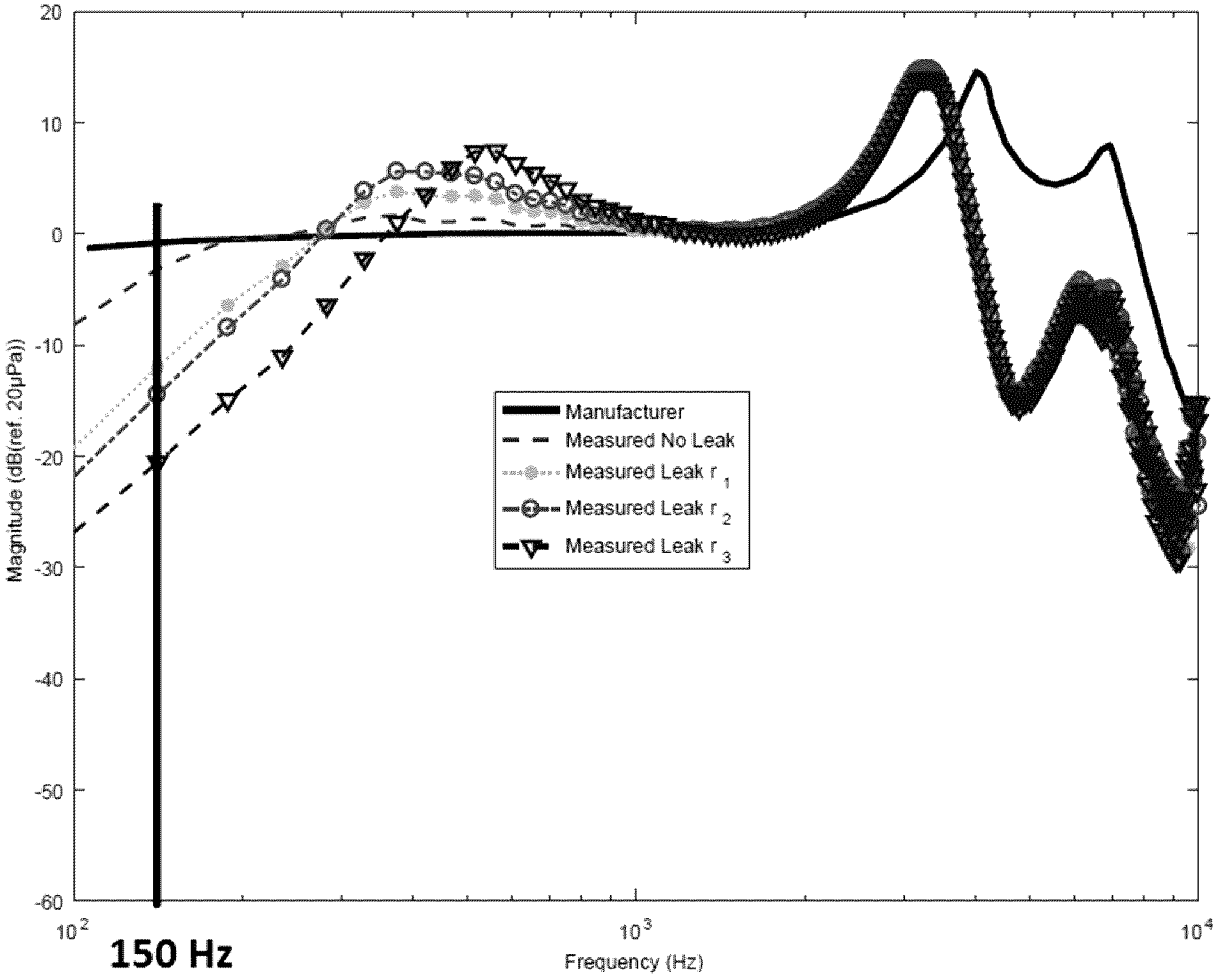
FIG. 8 is a graph presenting various transfer functions each corresponding to a different seal quality indicator, according to one embodiment.

Now referring to FIG. 8, according to one embodiment, a graph 800 presenting a comparison between different responses for normalized miniature loudspeakers (604*a* and 604*b*) in a leaky earpiece versus non-leaky earpiece positioned in ear-canal 12 is presented. The different results of the graph 800 correspond to an earpiece having no leak and to earpieces having leak radius sizes ranging from $r_1$ to $r_3$. As shown in FIG. 8, a decline in lower frequency magnitude is observed for earpieces having a leak. As illustrated in the graph 800, the extent of the leak may be estimated by measuring the magnitude at 150 Hz. At 150 Hz, the measured magnitude of the responses varies with greater distinction according to each leak radius size.

Figure 9:
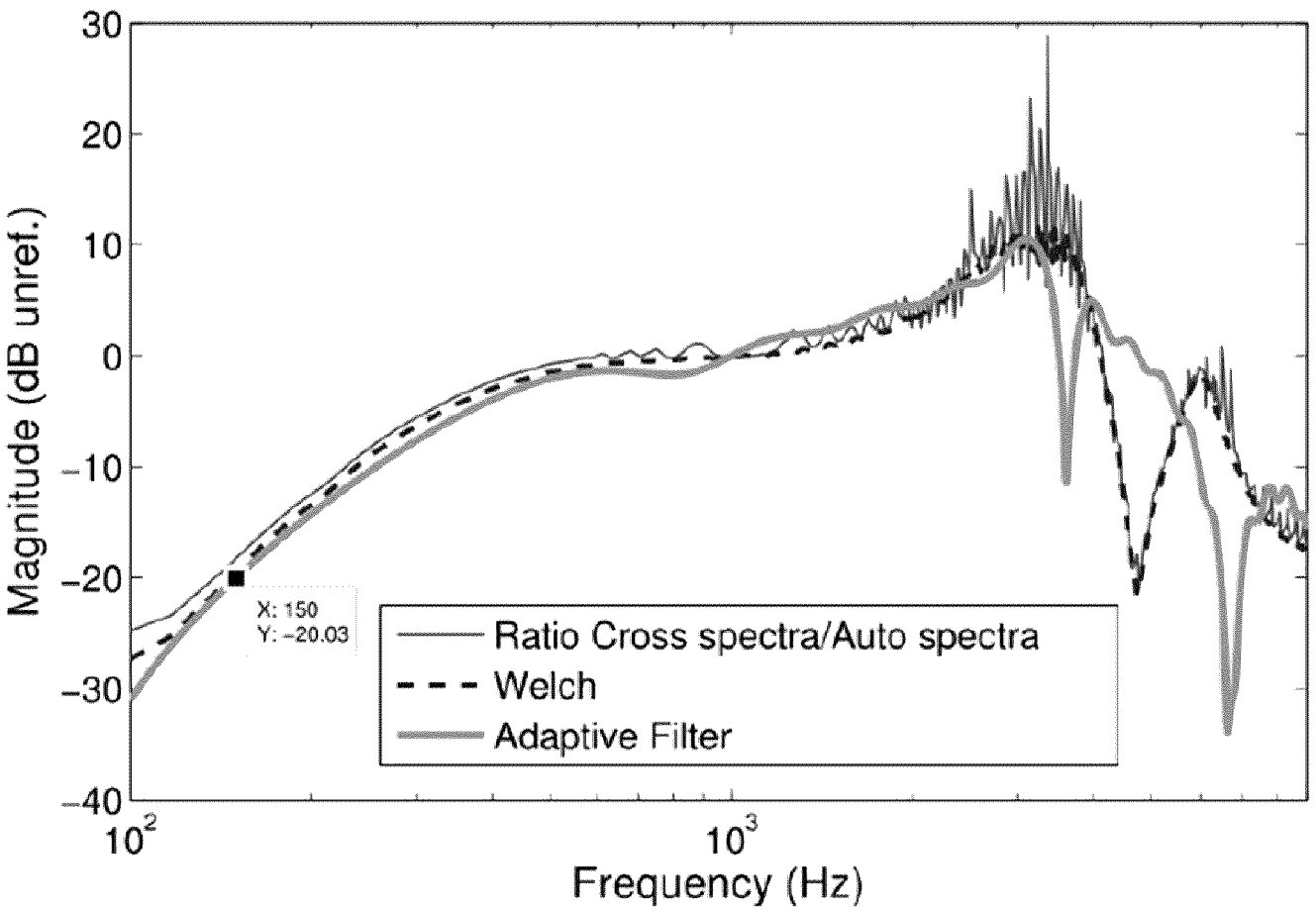
FIG. 9 is a graph presenting an example of a magnitude response calculated from the coefficients of an adaptive filter, according to one embodiment.

Now referring to FIG. 9, according to one embodiment, a graph 900 presenting a magnitude response calculated from the coefficients of an adaptive filter is presented. In this case, the response is normalized to 0 dB. As illustrated by the graph 900, the magnitude of the response is similar to other estimation methods, particularly for lower frequencies.

Figure 10:
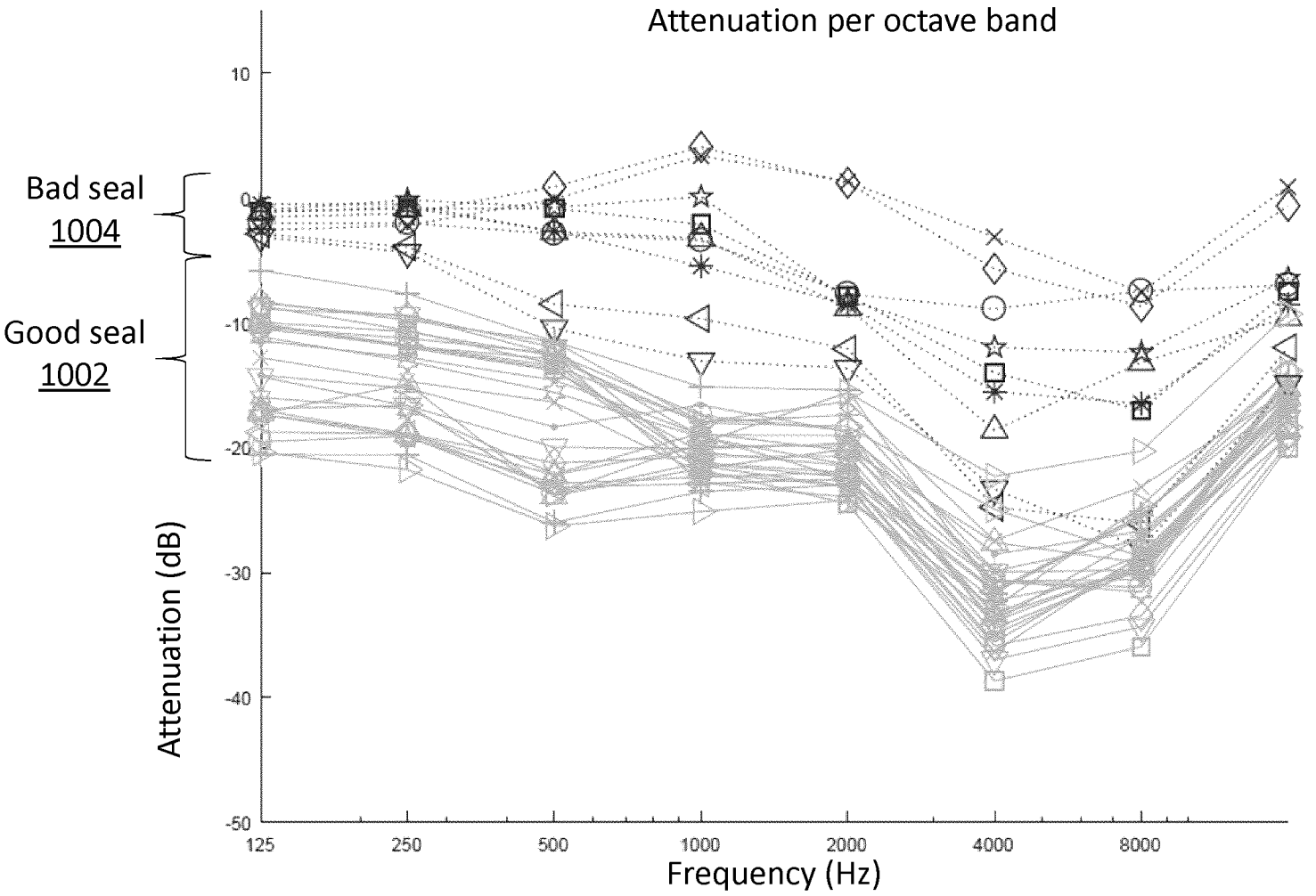
FIG. 10 is a graph presenting passive attenuation provided by an earpiece on twenty-four participants and arbitrarily corresponding to either a bad fit or good fit, according to one embodiment.

Now referring to FIG. 10, according to one embodiment, a graph 1000 presenting various passive attenuation levels provided by a custom fit earpiece worn by five different users and measured on different days at different moments of the day is presented. The lower plots (full lines) 1002 refer to a good seal based on a criterion at 250 Hz octave band and the above plots (dotted lines) 1004 refer a bad seal based on the same criterion.

Figure 11:
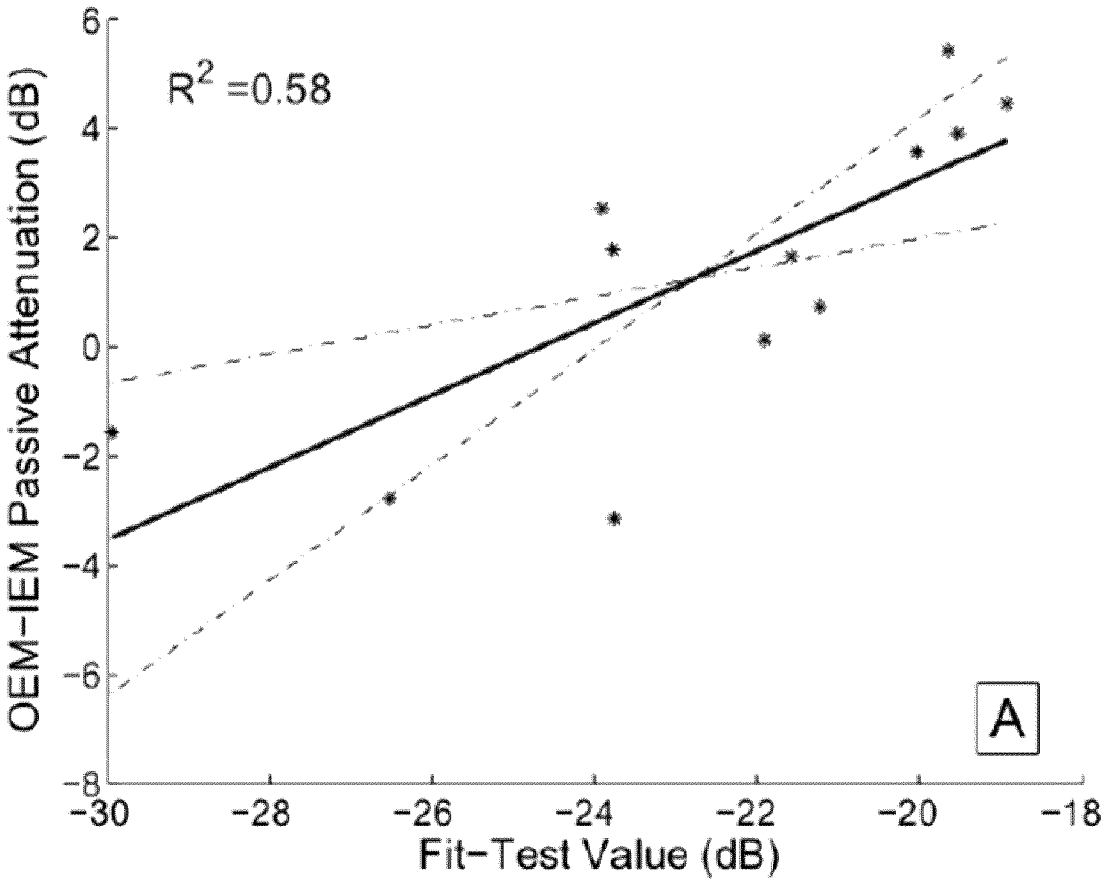
FIGS. 11 and 12 are graphs showing linear regression of the passive attenuation (dB) as a function of fit test values (dB), according to one embodiment.

Now referring to FIG. 11, according to one embodiment, a graph 1100 presenting linear regressions of the passive attenuation (dB) as a function of the seal assessment values (dB) is presented. The linear regressions use the above-mentioned seal assessment at 150 Hz on the x-axis and the passive attenuation of the earpiece calculated from the difference in the auto spectra between the OEM and the IEM at 500 Hz. $R^2$ is the coefficient of determination on the y-axis. It shall be recognized that the passive attenuation could be estimated on a frequency range from 125 Hz to 16000 Hz.

Figure 12:
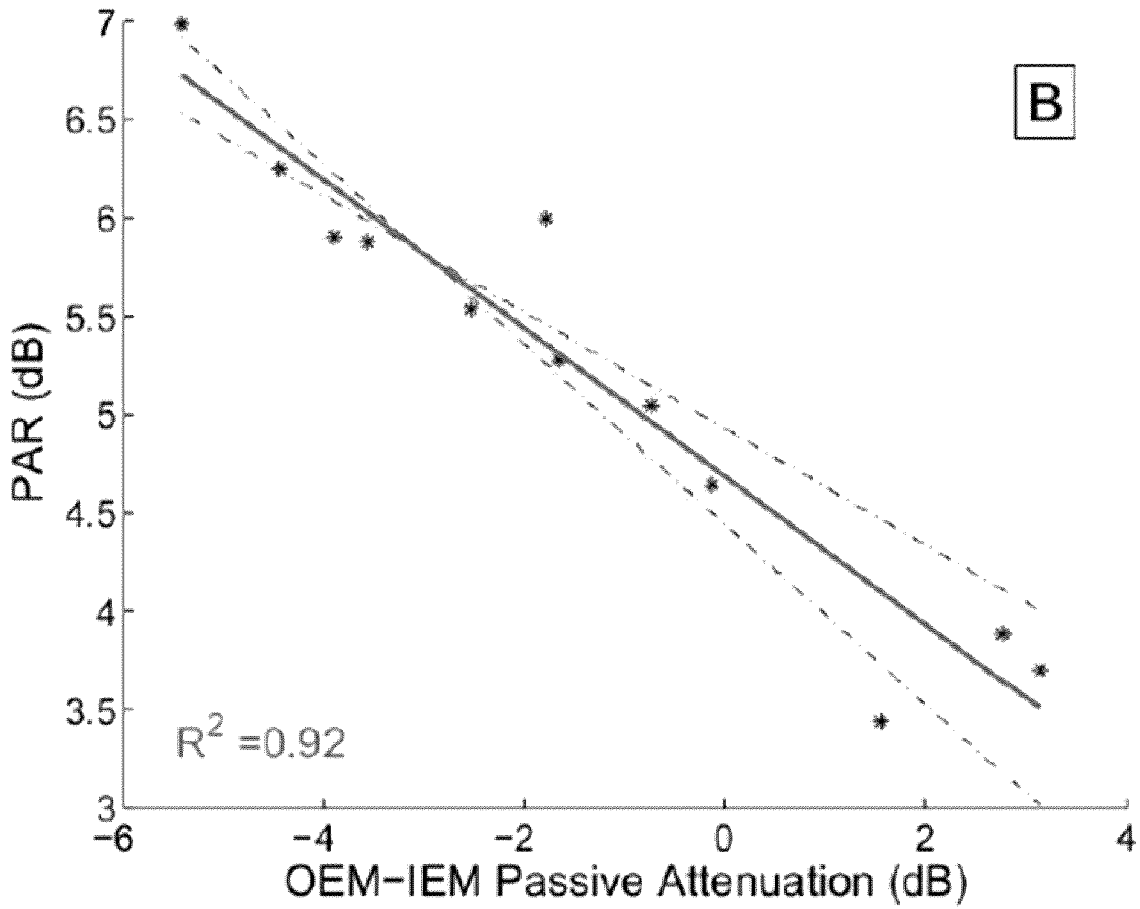
Figure 13:
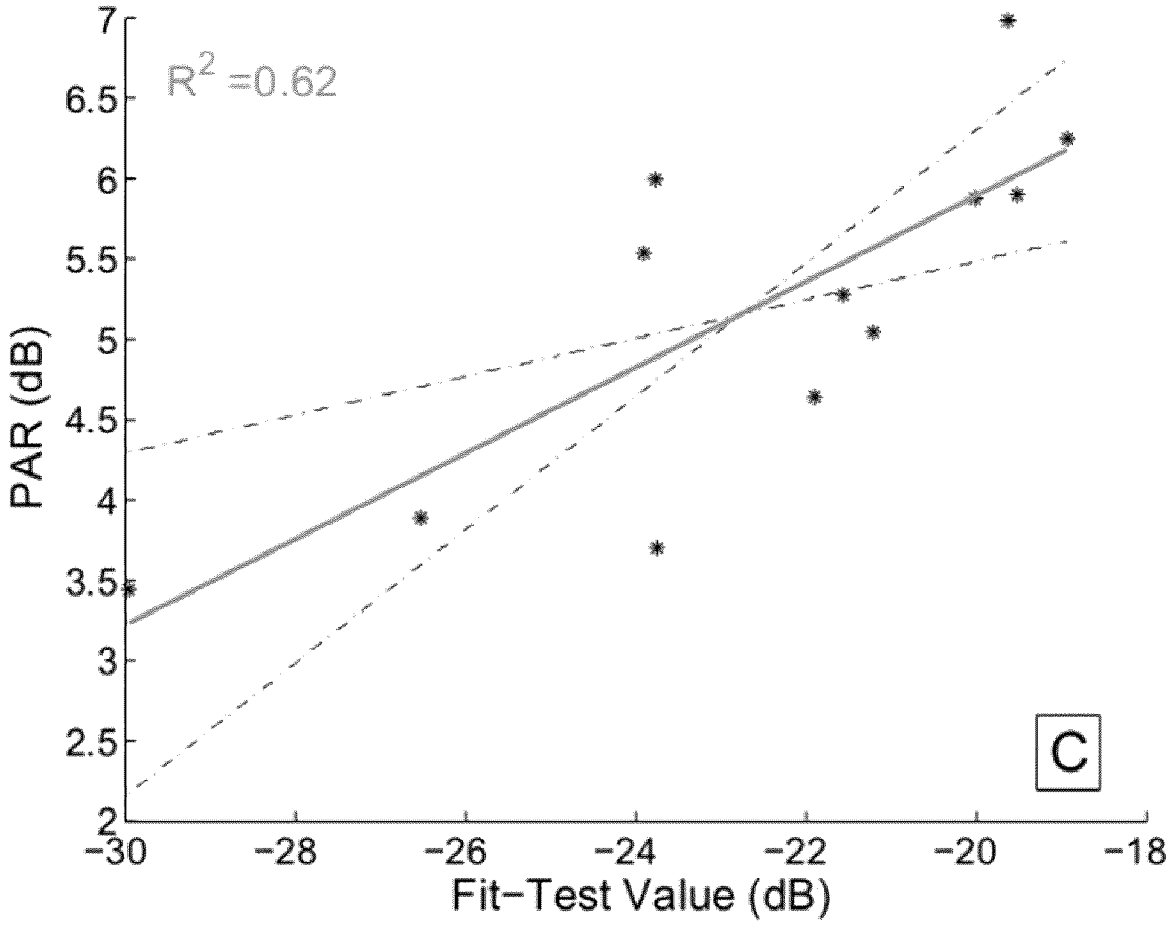
FIG. 13 are graphs showing linear regressions of the personal attenuation rating (dB) as a function the fit test values (dB), when in a silent environment, according to one embodiment.

Now referring to FIG. 12, according to one embodiment, a graph 1200 presenting linear regressions of the personal attenuation rating (dB) at 500 Hz as a function the seal assessment values (dB) in one embodiment is presented. The linear regressions are shown with the passive attenuation of the earpiece calculated from the difference in the auto spectra between the OEM and the IEM at 500 Hz on the x-axis and the personal attenuation rating (PAR) on the y-axis. $R^2$ is the coefficient of determination on the y-axis. It shall be recognized that the passive attenuation could have octave bands from 125 Hz to 8000 Hz on the x-axis Now referring to FIG. 13, according to one embodiment, a graph 1300 presenting linear regressions with the above-mentioned seal assessment at 150 Hz on the x-axis and the personal attenuation rating (PAR) on the y-axis is presented, $R^2$ being the coefficient of determination.

It shall be recognized that the seal quality indicator could be a PAR (Personal Attenuation Rating) indicator, a leak size indicator, a fit quality indicator, or any other type of seal quality indicator.

Seal-Test When in a Quiet or Noisy Environment

Figure 14:
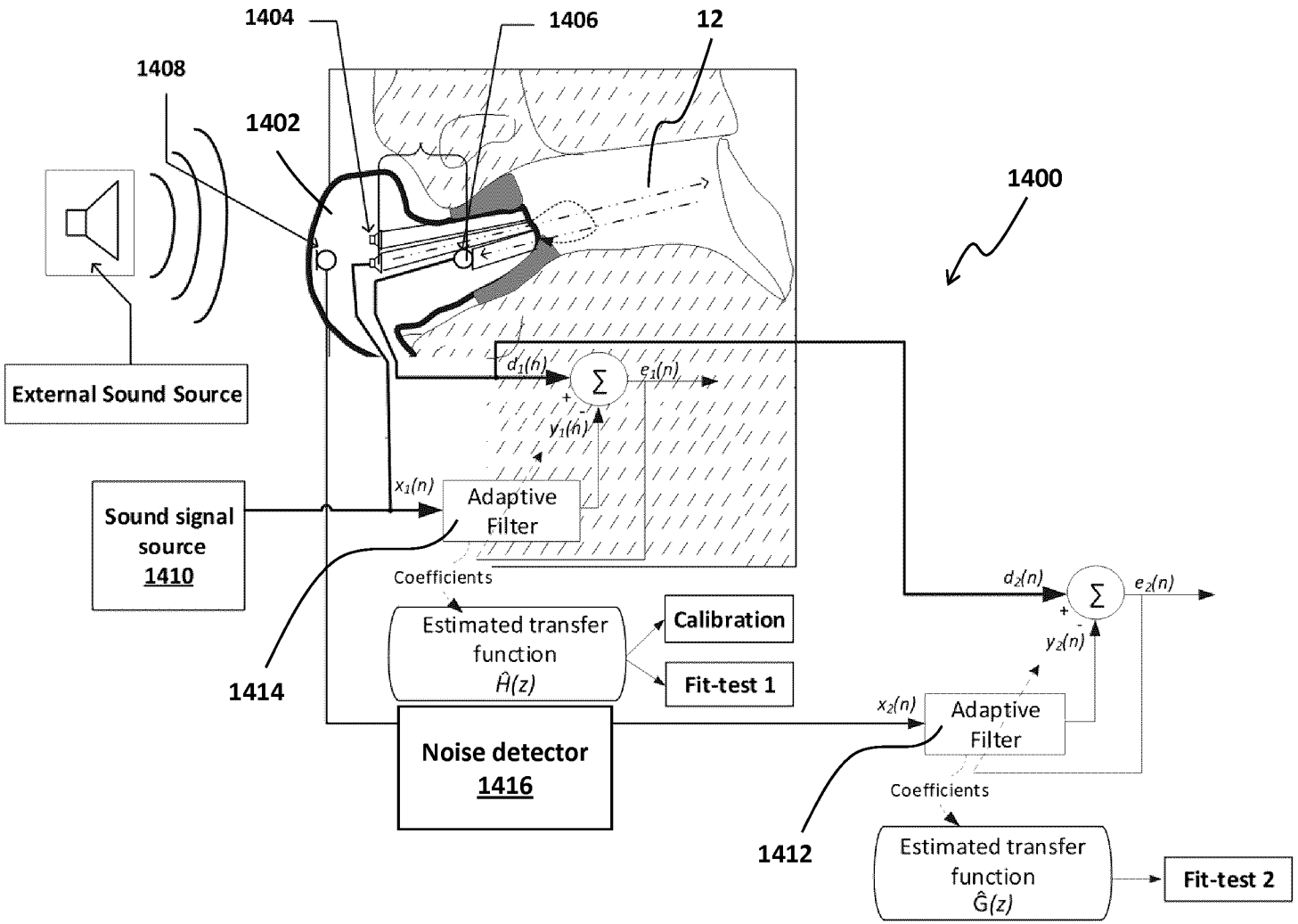
FIG. 14 is an illustration of an audio wearable device having an earpiece placed into an ear-canal entry of a wearer, the earpiece has an outer-ear microphone, an inner-ear microphone and a speaker for assessing a fit quality of the earpiece when worn in a noisy environment or in a silent environment, according to one embodiment.

According to one embodiment as presented in FIG. 14, there is a device 1400 for assessing a seal quality when in a quiet environment or when in a noisy environment. The device 1400 comprises an earpiece 1402 having at least one loudspeaker 1404 connected to a sound source 1410 adapted provide a pure tone signal at a predetermined seal assessment frequency. The earpiece 1402 also comprises an inner-ear microphone 1406 adapted to capture an inner audio signal from the ear-canal 12 and an outer-ear microphone 1408 adapted to capture an outer audio signal from an external sound source such as noise from the environment. The device 1400 further comprises a noise detector 1416 adapted to receive the outer audio signal and determine if the device 1400 is being worn in a noisy environment or in a silent or quiet environment. When in a noisy environment, a first adaptive filter 1412 is activated and a fit assessment indicator is determined according to the method 400 of FIGS. 4A and 4B. When in a silent or quiet environment, a second adaptive filter 1412 is activated and a seal assessment indicator is determined according to the method 700 of FIG. 7A.

It shall further be recognized that the estimated transfer function can be compared to another transfer function determined according to another seal quality assessment method, in order to assess a seal quality with greater accuracy. For instance, the estimated transfer function can be compared to another transfer function determined according to the fit quality assessment method 400 as presented in FIGS. 4A and 4B and assess a seal quality with greater reliability. Moreover, the estimated transfer function can be compared to a transfer function produced while in a noisy environment, such as presented in FIG. 14.

Seal Quality Assessment System

According to one embodiment, the proposed method 700 can be provided by a seal quality assessment system for an earpiece having a loudspeaker for emitting sounds towards the ear canal and an internal microphone for capturing an inner-ear audio signal inside the ear canal. The seal quality assessment system comprises a sound source generator adapted to generate a sound stimulus at a predetermined seal assessment frequency and a receiver adapted to receive the inner-ear audio signal of the sound stimulus as captured by the internal microphone. The system further comprises a modelization module adapted to estimate a transfer function of the earpiece while in use in a silent environment, according to a comparison of the sound stimulus and the received inner-ear audio signal. The system also has a signal magnitude identifier adapted to establish a signal magnitude of the transfer function at the predetermined seal assessment frequency and a seal quality assessor adapted to determine at least one seal-quality indicator according to the signal magnitude. The system has a seal quality communication module adapted to transmit a status information indicative of the seal quality indicator to the wearer or to a monitoring system. Once the fit quality indicator is determined, a communication module can transmit a status information corresponding to the fit quality indicator to either the wearer or to a monitoring system.

Embodiments of the present system, device and method generally require a reduced or low computational time. The limited computation time is generally obtained by using other computation methods than a Fast Fourier Transform (FFT) computation. The proposed solution uses a processor configured to provide adaptive filtering in order to identify the transfer function or filter coefficients efficiently and with a low computation cost.

The proposed solution allows to provide an assessment of the seal quality of the earpiece. The solution can be used with any type of audio wearable device comprising desired audio sensors, such as intra-/supra- or circum-aural wearable devices. In some embodiments, an audio sensor may be a microphone located outside the device, underneath the device or a loudspeaker generally located underneath the device.

The proposed method 700 is therefore capable of providing either a continuous, a periodic or an on-demand estimation of a fit of an earpiece while being simple to calculate in real-time or with a slight unnoticeable delay within a standalone in-ear audio wearable device 600, while in a silent environment.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. An audio wearable device comprising an earpiece for operatively preventing environment sounds from entering an ear-canal of a user, the earpiece comprising an external microphone for capturing an outer-ear audio signal outside the ear-canal and an internal microphone for capturing an inner-ear audio signal inside the ear canal, the audio wearable device further comprising:

a modelization module adapted to estimate an attenuation model of the earpiece while in use in a noisy environment, according to the captured outer-ear audio signal and the captured inner-ear audio signal, the attenuation model being indicative of an acoustic filter;

a coefficient identifier adapted to identify at least one group of acoustic filter coefficients according to the attenuation model; and a fit quality assessor adapted to analyse the group of acoustic filter coefficients and determine at least one fit quality indicator according to the at least one of the groups of acoustic filter coefficients.

2. The audio wearable device of claim 1, the fit quality assessor further comprising a coefficient analyser adapted to analyse the identified group of the acoustic filter coefficients and adapted to determine a ratio of coefficients of the acoustic filter coefficients that are within a predetermined coefficients threshold envelope.

3. The audio wearable device of claim 2, wherein the fit quality assessor further comprises a fit quality determinator adapted to determine the at least one fit quality indicator according to the determined ratio of coefficients.

4. The audio wearable device of claim 2, wherein the fit quality assessor further comprises an averaging module adapted to calculate an average of a plurality of ratio of coefficients, the plurality of ratio of coefficients being associated to one of a plurality of group of acoustic filter coefficients.

5. The audio wearable device of claim 1, the fit quality assessor further comprising a frequency response extractor adapted to calculate a frequency response over a predetermined group of frequency bands according to the acoustic filter coefficients.

6. The audio wearable device of claim 5, the fit quality assessor further comprising a fit quality determinator adapted to determine the at least one fit quality indicator according to the calculated frequency response.

7. The audio wearable device of claim 5, the fit quality assessor further comprising an averaging module adapted to calculate an average of the frequency responses, each of the frequency responses being associated to at least one of a plurality of the groups of filter coefficients.

8. A fit quality assessment system for an earpiece configured to prevent environment noise from entering an ear-canal of a wearer, the earpiece comprising an external microphone for capturing an outer-ear audio signal outside the ear-canal and an internal microphone for capturing an inner-ear audio signal inside the ear canal, the system comprising:

a first receiver adapted to receive the captured outer-ear audio signal;

a second receiver adapted to receive the captured inner-ear audio signal;

a modelization module configured to connect to the first and second receivers and to estimate a filter indicative of an attenuation provided by the earpiece while in use in a noisy environment, the filter being estimated according to the captured outer-ear audio signal and to the captured inner-ear audio signal;

a coefficient identifier configured to identify a group of filter coefficients according to the estimated filter;

a fit quality assessor configured to analyse the group of filter coefficients and determine at least one fit quality indicator according to the analysis; and a fit quality communication module configured to indicate a status information indicative of the fit quality indicator.

9. The fit quality assessment system of claim 8, the fit quality assessor further comprising a coefficient analyser configured to compare the group of filter coefficients according to a predetermined coefficients threshold envelope.

10. The fit quality assessment system of claim 9, the fit quality assessor further comprising a frequency response extractor configured to calculate a frequency response over a predetermined range of frequency bands according to the group of filter coefficients.

11. The fit quality assessment system of claim 8, the fit quality communication module being configured to connect to a monitoring system and to transmit the status information to the monitoring system.

12. The fit quality assessment system of claim 8, the fit quality communication module being configured to periodically transmit any one of the following:

the status information;

the status information to a monitoring module of the fit quality assessment system.

13. A method of assessing a fit quality of an earpiece, the earpiece being configured to prevent environment noise from entering an ear-canal of a wearer, the method comprising:

capturing an inner-ear sound signal from within an ear-canal of a user;

capturing an outer-ear sound signal from outside the ear-canal, the received outer-ear sound signal being indicative of a noisy environment;

estimating a digital filter according to the captured inner-ear sound signal and the captured outer-ear sound signal;

identifying coefficients of the estimated filter; and determining a fit quality according to the identified coefficients.

14. The method of assessing a fit quality of claim 13, wherein determining a fit quality further comprises any one of the following:

analysing the identified coefficients;

comparing the identified coefficients to a predetermined coefficients threshold envelope; or extracting a frequency response over a predetermined range of frequency bands according to the identified coefficients.

15. The method of assessing a fit quality of claim 13, the method further comprising verifying a filter accuracy according to the identified coefficients and wherein the fit quality is further determined according to a filter accuracy.

16. The method of assessing a fit quality of claim 13, wherein estimating a digital filter further comprises estimating a plurality of filters according to a plurality of received inner-ear sound signal and received outer-ear sound signal pairs and identifying a plurality of coefficient groups corresponding to each of the plurality of filters and determining a fit quality according to an average of the plurality of coefficient groups.

17. The method of assessing a fit quality of claim 13, wherein estimating a digital filter further comprises estimating a plurality of filters according to a plurality of received inner-ear sound signal and received outer-ear sound signal pairs and identifying a plurality of coefficient groups corresponding to each of the plurality of filters and determining a fit quality according to an average of the frequency responses, each of the frequency responses being associated to one of the plurality of coefficient groups.

18. The method of assessing a fit quality of claim 13, the method further comprising transmitting a status information indicative of the determined fit quality to a speaker of the earpiece.

19. The method of assessing a fit quality of claim 13, wherein the inner-ear sound signal is captured using a microphone.

20. The method of assessing a fit quality of claim 13, wherein the outer-ear sound signal is captured using a microphone.

* * * * *